US011254457B2

(12) United States Patent
McDonald et al.

(10) Patent No.: US 11,254,457 B2
(45) Date of Patent: Feb. 22, 2022

(54) METHOD OF POSITIONING AND SEALING A BAG IN A VACUUM CHAMBER, BAG POSITIONING APPARATUS, AND METHOD OF MANUFACTURING A PATCH BAG

(71) Applicant: Sealed Air Corporation (US), Charlotte, NC (US)

(72) Inventors: Gregory E McDonald, Simpsonville, SC (US); Jeffrey R Iocco, Greenville, SC (US); Julian L Pruitt, Greer, SC (US); Max C Painter, Spartanburg, SC (US)

(73) Assignee: Sealed Air Corporation (US), Charlotte, NC (US)

( * ) Notice: Subject to any disclaimer, the term of this patent is extended or adjusted under 35 U.S.C. 154(b) by 738 days.

(21) Appl. No.: 15/566,269

(22) PCT Filed: Apr. 13, 2016

(86) PCT No.: PCT/US2016/027186

§ 371 (c)(1),
(2) Date: Oct. 13, 2017

(87) PCT Pub. No.: WO2016/168228

PCT Pub. Date: Oct. 20, 2016

(65) Prior Publication Data

US 2018/0099769 A1 Apr. 12, 2018

Related U.S. Application Data

(60) Provisional application No. 62/147,317, filed on Apr. 14, 2015.

(51) Int. Cl.
*B65B 57/00* (2006.01)
*B65B 31/02* (2006.01)
(Continued)

(52) U.S. Cl.
CPC ..... *B65B 31/024* (2013.01); *B65B 25/001* (2013.01); *B65B 35/24* (2013.01);
(Continued)

(58) Field of Classification Search
CPC ..... B65B 51/146; B65B 57/00; B65B 57/04; B65B 57/08; B65B 57/10; B65B 57/12; B65B 31/024
(Continued)

(56) References Cited

U.S. PATENT DOCUMENTS 3,958,391 A 5/1976 Kujubu
4,147,930 A 4/1979 Browne et al.
(Continued)

FOREIGN PATENT DOCUMENTS

EP 0999140 5/2000
EP 1095874 5/2001
(Continued)

*Primary Examiner* — Chelsea E Stinson
(74) *Attorney, Agent, or Firm* — Jason R. Womer

(57) ABSTRACT

A method of positioning and sealing a bag in a vacuum chamber, includes detecting a trailing edge of a product in the bag, detecting a trailing edge of a patch adhered to the bag, controlling advancement of the bag, and closing the bag. A bag positioning apparatus includes an infrared sensing apparatus, a fluorescence sensing apparatus, and a controller. A method of manufacturing a patch bag includes adhering a first patch to film stock, detecting a position of the first patch, aligning a second patch with the first patch, and adhering the second patch to the film stock. A method of manufacturing a patch bag includes detecting an edge of a patch adhered to film stock, forming a seal across the film stock adjacent to the edge of the patch, and severing the film stock adjacent to the edge of the patch.

24 Claims, 25 Drawing Sheets

(51) Int. Cl.

| | |
|---|---|
| ***B65B 57/04*** | (2006.01) |
| ***B65B 57/12*** | (2006.01) |
| ***B65B 51/14*** | (2006.01) |
| ***B65B 25/00*** | (2006.01) |
| ***B65B 35/24*** | (2006.01) |
| ***B65B 51/10*** | (2006.01) |
| ***B65B 57/14*** | (2006.01) |

(52) U.S. Cl.
CPC ..... *B65B 51/10* (2013.01); *B65B 51/146* (2013.01); *B65B 57/00* (2013.01); *B65B 57/04* (2013.01); *B65B 57/12* (2013.01); *B65B 57/14* (2013.01)

(58) Field of Classification Search
USPC ..... 53/434, 52
See application file for complete search history.

(56) References Cited

U.S. PATENT DOCUMENTS

| | | | |
|---|---|---|---|
| 4,159,761 | A | 7/1979 | Egee et al. |
| 4,446,481 | A | 5/1984 | Edamatsu et al. |
| 4,640,081 | A | 2/1987 | Kawaguchi et al. |
| 4,755,403 | A | 7/1988 | Ferguson |
| 4,850,393 | A | 7/1989 | Lashomb |
| 4,882,498 | A | 11/1989 | Cochran et al. |
| 4,909,356 | A | 3/1990 | Rimondi et al. |
| 5,165,218 | A | 11/1992 | Callahan |
| 5,313,766 | A | 5/1994 | Rimondi et al. |
| 5,365,084 | A | 11/1994 | Cochran et al. |
| 5,420,429 | A | 5/1995 | Eberhard et al. |
| 5,524,420 | A | 6/1996 | Ikuta |
| 5,646,724 | A | 7/1997 | Hershline |
| 5,799,465 | A | 9/1998 | Townsend |
| 5,810,795 | A | 9/1998 | Westwood |
| 5,941,052 | A | 8/1999 | Evangelisti |
| 6,119,438 | A | 9/2000 | Bacon et al. |
| 6,383,537 | B1 | 5/2002 | Brady et al. |
| 6,384,421 | B1 | 5/2002 | Gochar |
| 6,415,582 | B2 | 7/2002 | Graushar et al. |
| 6,542,235 | B1 | 4/2003 | Caskey et al. |
| 6,563,576 | B2 | 5/2003 | Gschweitl |
| 6,725,635 | B2 | 4/2004 | Koppe |
| 6,784,447 | B2 | 8/2004 | Gochar |
| 6,790,468 | B1 | 9/2004 | Mize et al. |
| 6,877,543 | B2 | 4/2005 | Stevens |
| 6,907,711 | B2 | 6/2005 | Ishii et al. |
| 7,255,903 | B1 | 8/2007 | Mudar et al. |
| 7,296,390 | B2 | 11/2007 | Koke et al. |
| 7,687,123 | B2 | 3/2010 | Broadus et al. |
| 7,891,159 | B2 * | 2/2011 | Iocco ..... B65B 31/024 53/432 |
| 2004/0118735 | A1 | 6/2004 | Mize et al. |
| 2005/0039417 | A1 | 2/2005 | Liedtke et al. |
| 2005/0178090 | A1 | 8/2005 | Koke et al. |
| 2005/0231713 | A1 | 10/2005 | Owen et al. |
| 2006/0244954 | A1 | 11/2006 | Daley et al. |
| 2013/0340389 | A1 * | 12/2013 | Harder ..... B65B 57/08 53/405 |
| 2018/0259092 | A1 * | 9/2018 | McDonald ..... B29C 66/73921 |

FOREIGN PATENT DOCUMENTS

| | | |
|---|---|---|
| WO | 2009145885 | 12/2009 |
| WO | 2012178204 | 12/2012 |

* cited by examiner

METHOD OF POSITIONING AND SEALING A BAG IN A VACUUM CHAMBER, BAG POSITIONING APPARATUS, AND METHOD OF MANUFACTURING A PATCH BAG

FIELD

The disclosure relates generally to a method of positioning and sealing a bag in a vacuum chamber, a bag positioning apparatus, and a method of manufacturing a patch bag.

BACKGROUND

Patch bags are known for the packaging of bone-in meat products, such as whole bone-in pork loins, etc. The patch reduces the likelihood of film puncture from protruding bones.

Vacuum packaging in heat sealable plastic bags, e.g., patch bags or patchless bags, is a conventional way of packaging food products such as meat and cheese. Vacuum packaging typically involves placing the food item in a heat sealable plastic bag having a bag mouth, and then evacuating air from the bag through the bag mouth and collapsing the bag about the contained food item. The bag is then heat sealed in this evacuated condition so the food item becomes encased in a generally air-free environment. Often the bag is a heat-shrinkable bag, and after the heat sealing step, the bag is advanced to a hot water or hot air shrink tunnel to induce shrinkage of the bag around the food item.

Vacuum packaging machines of a known type include a vacuum chamber arranged to receive unsealed loaded bags and operable to perform a vacuum sealing operation on the loaded bags. Typically, the loaded bags contain products such as meat cuts, arranged in bags formed by a heat-shrinkable film. After feeding a loaded bag to a vacuum chamber and closing the vacuum chamber, the vacuum sealing operation typically includes evacuating atmosphere from within the chamber, sealing closed the mouth of the evacuated bag, and reintroducing air into the chamber. The chamber is then opened and the vacuum chamber is unloaded. In some applications, the packages may then be conveyed to a heat-shrinking unit to shrink the packaging around the product.

Rotary vacuum packaging machines typically include a series of vacuum chambers and chain driven product platens. In operation of the machine, the platens move from a loading position, through a vacuum/sealing/venting stage, to an unloading position, and finally back to the loading position.

Some non-rotary vacuum packaging machines include a plurality of stacked and vertically movable vacuum chambers.

U.S. Pat. No. 7,891,159, to locco et al, which is hereby incorporated, in its entirety, by reference thereto, discloses that a method of positioning a loaded bag in a vacuum chamber includes loading a bag by placing a product in the bag; placing the bag on an infeed conveyor that is transparent to IR; advancing the bag, on the conveyor, to a sensing apparatus including an infrared camera disposed above the conveyor, and a bank of LED's disposed below the conveyor; interrogating the loaded bag, using the sensing apparatus, with infrared radiation to detect the trailing edge of the product inside the bag; transmitting information acquired from the interrogating step to a PLC; advancing the interrogated loaded bag a distance, based in the information acquired from the interrogating step, to a vacuum chamber including a heat seal assembly; and heat sealing the loaded bag with the heat seal assembly to close the bag mouth.

SUMMARY

A first aspect is directed to a method of positioning and sealing a bag in a vacuum chamber comprising loading the bag by placing a product in the bag to produce a loaded bag, the bag including an upstream end including a bag mouth, the bag further including a patch adhered thereto, the patch including a fluorescent material, the bag and the patch both being transparent to infrared radiation;

placing the loaded bag on an infeed conveyor;

advancing the loaded bag, on the infeed conveyor, to an infrared sensing apparatus including an infrared detector and a first radiation source, the infrared detector being disposed on an opposite side of the infeed conveyor from the first radiation source;

detecting a trailing edge of the product inside the loaded bag by interrogating, through the loaded bag, infrared radiation emitted from the first radiation source, using the infrared sensing apparatus;

advancing the loaded bag to a fluorescence sensing apparatus including a fluorescence detector and a second radiation source;

detecting a trailing edge of the patch by interrogating fluorescence emitted by the patch using the fluorescence sensing apparatus, wherein radiation emitted by the second radiation source excites the fluorescent material;

acquiring information from detecting the trailing edge of the product and detecting the trailing edge of the patch, and transmitting the information to a controller;

controlling a distance of advancement of the loaded bag to a sealing position in the vacuum chamber including a heat seal assembly, using the controller, based on the information acquired from detecting the trailing edge of the product and detecting the trailing edge of the patch; and closing the loaded bag by heat sealing the loaded bag, using the heat seal assembly, so that a heat seal is applied between the trailing edge of the product and the bag mouth and between the trailing edge of the patch and the bag mouth.

In an embodiment, the method further comprises applying vacuum to the loaded bag within the vacuum chamber before closing the loaded bag.

In an embodiment, the infeed conveyor is transparent to infrared radiation.

In an embodiment, the fluorescence sensing apparatus is disposed adjacent to an end of the infeed conveyor.

In an embodiment, the fluorescence detector includes a fluorescence detecting camera or a fluorescence detecting sensor, and the infrared detector includes an infrared detecting camera or an infrared detecting sensor.

In an embodiment, the second radiation source includes an ultraviolet radiation source.

In an embodiment, the first radiation source includes a first array of light emitting diodes and the second radiation source includes a second array of light emitting diodes.

In an embodiment, the heat seal is applied at a controlled distance from the trailing edge of the product or the trailing edge of the patch. In an embodiment, the controlled distance is 0.5 to 3 inches.

In an embodiment, the product is a meat product or a cheese product.

In an embodiment, the product is a meat product including an irregular shape.

In an embodiment, the vacuum chamber includes an internal conveyor moveable in a longitudinal direction of the vacuum chamber to expel the loaded bag from the vacuum chamber after closing the loaded bag. In an embodiment, a portion of the internal conveyor extends under a portion of the heat seal assembly in the vacuum chamber. In an embodiment, at least a portion of the heat seal assembly is retractable to enable the loaded bag to be moved past the heat seal assembly on the internal conveyor.

In an embodiment, the method further comprises transferring the loaded bag from a placement conveyor to the infeed conveyor, wherein the radiation emitted from the second radiation source excites the fluorescent material through a gap between the placement conveyor and the infeed conveyor.

In an embodiment, the infrared detector is disposed above the infeed conveyor and the first radiation source.

In an embodiment, the trailing edge of the product is detected as the loaded bag is advanced along the infeed conveyor.

In an embodiment, the method is performed in combination with a method of vacuum sealing a stream of loaded bags including patchless bags and bags including patches adhered thereto, wherein a distance of advancement of a loaded patchless bag into the vacuum chamber is controlled by the controller based only on the information acquired from detecting the trailing edge of the product.

In an embodiment, the trailing edge of the patch is detected before the trailing edge of the product is detected.

In an embodiment, the controller is a programmable logic controller.

In an embodiment, the method is performed in combination with a method of vacuum sealing a loaded bag comprising:

providing a vacuum packaging machine including at least two vacuum chambers, wherein each of the at least two vacuum chambers is configured to receive a respective unsealed loaded bag and perform a vacuum sealing operation on the respective loaded bag, each of the at least two vacuum chambers includes a longitudinal direction defined by a path of travel of the respective loaded bag into the chamber, each of the at least two vacuum chambers includes a heat seal assembly for forming a heat seal across a bag mouth of the respective loaded bag, the heat seal assembly is disposed transversely to the longitudinal direction;

feeding the respective unsealed loaded bag into one of the at least two vacuum chambers, such that the bag mouth of the respective loaded bag is located adjacent to the heat seal assembly; and performing a vacuum sealing operation on another loaded bag in another vacuum chamber of the at least two vacuum chambers. In an embodiment, the at least two vacuum chambers are moveable relative to the infeed conveyor to enable selective feeding of a single loaded bag into each chamber of the at least two vacuum chambers. In an embodiment, the vacuum packaging machine is a rotary vacuum packaging machine. In an embodiment, the respective unsealed loaded bag is fed into one of the at least two vacuum chambers while performing a vacuum sealing operation on another loaded bag in another vacuum chamber of the at least two vacuum chambers.

A second aspect is directed to a bag positioning apparatus comprising an infeed conveyor;

an infrared sensing apparatus including an infrared detector and a first radiation source, the infrared detector being disposed on an opposite side of the conveyor from the first radiation source, wherein the infrared sensing apparatus is configured to detect a trailing edge of a product loaded inside the bag, the bag being transparent to infrared radiation, by interrogating the first radiation source through the loaded bag;

a fluorescence sensing apparatus including a fluorescence detector and a second radiation source, wherein the fluorescence sensing apparatus is configured to detect a trailing edge of a patch adhered to the bag, the patch including a fluorescent material, by interrogating fluorescence emitted by the patch, and radiation from the second radiation source excites the fluorescent material; and a controller configured to control a distance of advancement of the loaded bag along the infeed conveyor based on information from the infrared sensing apparatus and the fluorescence sensing apparatus.

A third aspect is directed to a method of manufacturing a patch bag comprising adhering a first patch to a first portion of film stock, wherein the first patch includes a fluorescent material;

advancing the film stock past a radiation emitter and a fluorescence detector, wherein the radiation emitter irradiates the first patch adhered to the film stock to excite the fluorescent material;

detecting a position of the first patch on the film stock by interrogating fluorescence emitted by the fluorescent material using the fluorescence detector, acquiring information from detecting the position of the first patch, and transmitting the information to a controller;

aligning a second patch with the position of the first patch, using the controller; and adhering the second patch to a second portion of the film stock on an opposite side of the film stock from the first portion, while the second patch is aligned with the position of the first patch. In an embodiment, the film stock is tubing film stock. In an embodiment, the fluorescence detector detects a position of a leading edge of the first patch when detecting the position of the first patch. In an embodiment, the fluorescence detector detects a position of a trailing edge of the first patch when detecting the position of the first patch.

A fourth aspect is directed to a method of manufacturing a patch bag comprising advancing film stock past a radiation emitter and a fluorescence detector, wherein the radiation emitter irradiates patches adhered to the film stock to excite a fluorescent material included in the patches, and the patches are spaced apart along a longitudinal direction of the film stock;

detecting an edge of a patch of the patches adhered to the film stock by interrogating fluorescence emitted from the fluorescent material using the fluorescence detector;

acquiring information from detecting the edge of the patch of the patches, and transmitting the information to a controller;

forming a seal across a width of the film stock at a first position adjacent to the edge of the patch of the patches; and severing the film stock, across the width of the film stock, at a second position adjacent to the edge of the patch of the patches to form the patch bag. In an embodiment, the film stock is tubing film stock. In an embodiment, the detected edge of the patch of the patches is a leading edge. In an embodiment, the detected edge of the patch of the patches is a trailing edge. In an embodiment, the seal formed before the film stock is severed. In an embodiment, the film stock is severed at a position between patches, and the seal is formed through the film stock at a position between the detected edge of the patch of the patches and a position where the film stock is to be severed. In an embodiment, the film stock is severed at a position between patches, and the seal is formed through the patch of the patches at a position adjacent to the detected edge of the patch of the patches.

DETAILED DESCRIPTION

Figure 1:
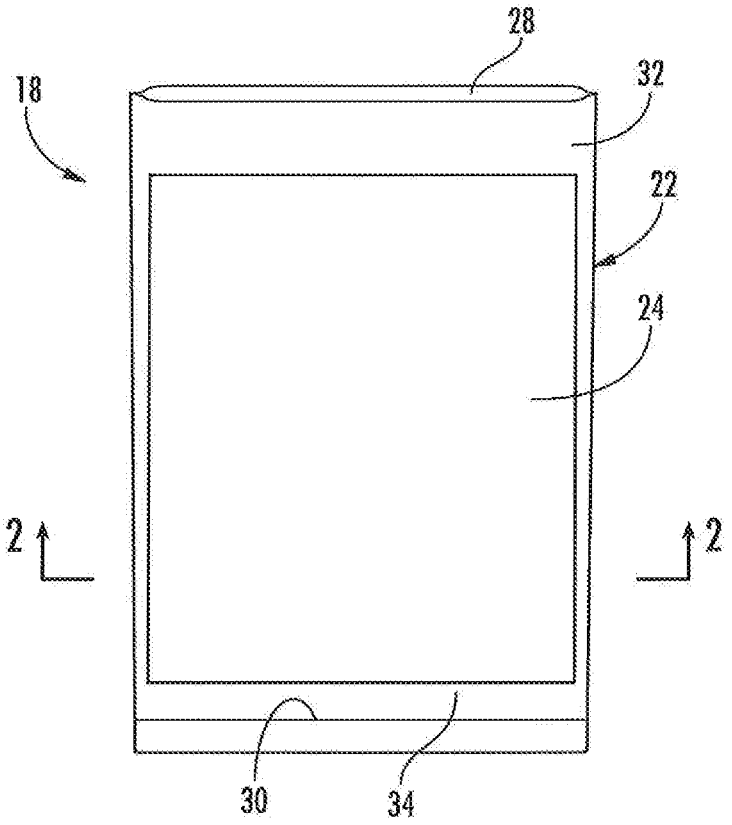
FIG. 1 PRIOR ART
FIG. 1 illustrates a lay-flat view of a prior art end-seal patch bag.

A bag including a patch adhered thereto is hereinafter referred to as a patch bag; and a bag without a patch adhered thereto is hereinafter referred to as a patchless bag. During the manufacture of patch bags, patch films are adhered to film stock. The film stock is sealed and cut into individual patch bags.

Patch bags are well known, and are disclosed in the following U.S. patents and other documents, each of which is hereby incorporated, in its entirety, by reference thereto: U.S. Pat. Nos. 4,755,403; 4,765,857; 4,770,731; 6,383,537; 6,790,468; 7,255,903; as well as WO 96/00688 (Brady et al.), and Canadian Patent No. 2 193 982 (Brady et al.).

As used herein, the term "bag" is inclusive of end-seal bags, L-seal bags, side-seal bags, back-seamed bags, pouches, etc., with or without patches adhered thereto. An end-seal bag has a tubular shape with open top and a bottom seal. An L-seal bag has an open top, a bottom seal, one side-seal along a first side edge, and a seamless (i.e., folded, unsealed) second side edge. A side-seal bag has an open top, a seamless bottom edge, with each of its two side edges having a seal therealong. Although seals along the side and/or bottom edges can be at the very edge itself, the seals may be spaced inward (e.g. ¼ to ½ inch, more or less) from the bag side edges, and the seals may be made using an impulse-type heat sealing apparatus, which utilizes a bar which is quickly heated and then quickly cooled. A back-seamed bag is a bag having an open top, a seal running the length of the bag in which the bag film is either fin-sealed or lap-sealed, two seamless side edges, and a bottom seal along a bottom edge of the bag.

A bag may optionally be heat-shrinkable, and a patch may optionally be heat-shrinkable. A patch bag may include heat-shrinkable patch adhered to a heat-shrinkable bag. As used herein, the phrase "heat-shrinkable" and the like applies to films having a total free shrink (i.e., longitudinal plus transverse (L+T)) at 85° C. of at least 10 percent, measured in accordance with ASTM D 2732.

As used herein, the term "corona treatment" is inclusive of subjecting the surfaces of thermoplastic materials, such as polyolefins, to corona discharge, i.e., the ionization of a gas such as air in close proximity to a film surface, the ionization initiated by a high voltage passed through a nearby electrode, and causing oxidation and other changes to the film surface, such as surface roughness and increased surface energy.

As used herein, the term "adhered" is inclusive of films which are directly adhered to one another using a heat seal, corona treatment, etc., as well as films which are adhered to one another using an adhesive which is between the two films.

A patch can be adhered to a bag by methods including adhesive, corona treatment, or heat seal. In embodiments, adhesives are used to accomplishing adhesion of the patch to the bag. Suitable adhesives include thermoplastic acrylic emulsions, solvent based adhesives, high solids adhesives, ultraviolet-cured adhesives, electron-beam cured adhesives, etc. In an embodiment, an adhesive is a water-based acrylic two-part system including C-CAT 104™ polyol-polyether co-reactant and PURETHANE® A-1078 CVAC water-based polyurethane, both obtained from Ashland, Inc. In another embodiment, an adhesive is a thermoplastic acrylic emulsion known as RHOPLEX® N619 thermoplastic acrylic emulsion, obtained from the Rohm & Haas Company.

As used herein, the terms "radiation emitter" and "second radiation source" are inclusive of any source of radiation (e.g., a lamp, an array of lamps, a light emitting diode (LED), an array of LEDs, an ultraviolet lamp, an array of ultraviolet lamps, an ultraviolet LED, an array of ultraviolet LEDs, an ultraviolet lamp capable of emitting radiation with a wavelength of 365 nm, an array of ultraviolet lamps capable of emitting radiation with a wavelength of 365 nm, an ultraviolet LED capable of emitting radiation with a wavelength of 365 nm, an array of ultraviolet LEDs capable of emitting radiation with a wavelength of 365 nm, etc.) that is capable of exciting fluorescent materials included in patches.

As used herein, the term "controller" is inclusive of a computer, a programmable logic controller, or any other electronic processing unit.

As used herein, the term "first radiation source" is inclusive of any source of infrared radiation, e.g., an infrared lamp, an array of infrared lamps, an infrared LED, an array of infrared LEDs, etc.

As used herein, the term "fluorescence detector" is inclusive of any device (e.g., fluorescence detecting camera, an array of fluorescence detecting cameras, fluorescence detecting sensor, an array of fluorescence detecting sensors, etc.) that is capable of detecting fluorescence emitted from a patch.

As used herein, the term "infrared detector" is inclusive of any device (e.g., an infrared detecting camera, an array of fluorescence detecting cameras, an infrared detecting sensor, an array of infrared detecting sensors, etc.) that is capable of detecting infrared radiation.

As used herein, the term "fluorescent material" is inclusive of any material that fluoresces upon exposure to radiation.

As used herein, the term "vacuum sealing" is inclusive of evacuating an atmosphere from within a vacuum chamber; sealing closed an evacuated bag in the vacuum chamber; and reintroducing the atmosphere into the chamber.

Although the films used in a patch bag can be monolayer films or multilayer films, the patch bag includes at least two films laminated together. In embodiments, the patch bag may be comprised of films which together comprise a total of from 2 to 20 layers; from 2 to 12 layers; or from 4 to 12 layers. In general, the multilayer film(s) can have any total thickness desired, so long as the film provides the desired properties for the particular packaging operation in which the film is used, e.g., abuse-resistance (especially puncture-resistance), modulus, seal strength, optics, etc.

Figure 2:
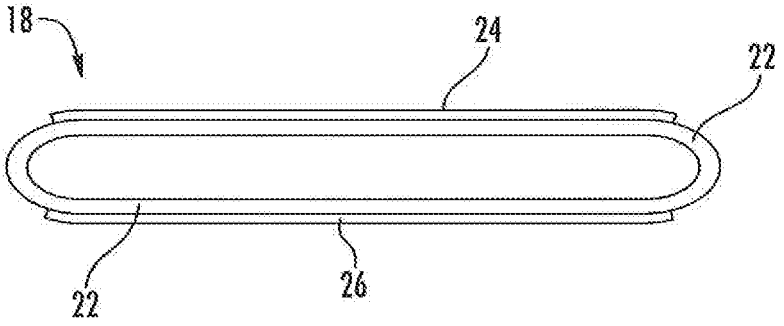
FIG. 2 PRIOR ART
FIG. 2 illustrates a cross-sectional view of the patch bag of FIG. 1, taken through section 2-2 thereof.

FIG. 1 is a lay-flat view of an end-seal patch bag 18, in a lay-flat position. FIG. 2 is a transverse cross-sectional view of patch bag 18, taken through section 2-2 of FIG. 1. Viewing FIGS. 1 and 2 together, patch bag 18 includes bag 22, first patch 24, second patch 26, open top 28, and end-seal 30.

Those portions of bag 22 to which patches 24 and 26 are adhered are "covered", i.e., protected, by patches 24 and 26, respectively. In an embodiment, upper and lower end portions 32 and 34 (respectively) of bag 22 are not covered by patch 24, for ease in producing end-seal 30, made before a product is placed in the bag, as well as a top-seal (not illustrated in FIG. 1) made after a product is placed in the bag. A heat seal can be made through the patch and the bag as disclosed in U.S. Pat. No. 7,670,657, which is hereby incorporated, in its entirety, by reference thereto.

Figure 3:
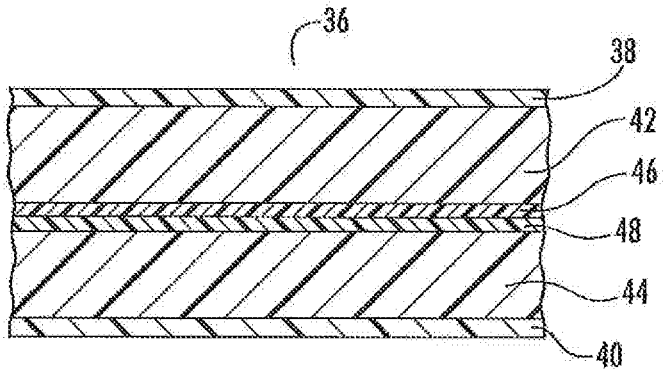
FIG. 3 PRIOR ART
FIG. 3 illustrates a cross-sectional view of a prior art multilayer film for use in an embodiment of a patch.

FIG. 3 illustrates a cross-sectional view of an embodiment of a multilayer film 36 for use as a patch film from which patches 24 and 26 are formed. In some embodiments, a patch film from which the patches are cut has a total thickness of from about 2 to 8 mils; or from about 3 to 6 mils. In the embodiment illustrated in FIG. 3, the multilayer film 36 has outer layers 38 and 40, intermediate layers 42 and 44, and self-weld layers 46 and 48. In this embodiment, the multilayer film 36 has a physical structure, in terms of number of layers, layer thickness, and layer arrangement and orientation in the patch bag, and a chemical composition in terms of the various polymers, etc. present in each of the layers, as set forth in Table I, below.

TABLE I

| Layer Designation | Layer Function | Layer Chemical Identity | Layer Thickness (mils) |
|---|---|---|---|
| 46, 48 | Self-weld layers | 100% EAA | 0.48 (layers 46 and 48 combined) |
| 42, 44 | Intermediate layers | 100% VLDPE #1 | 3.16 (layers 42 and 44 combined) |
| 38, 40 | Outer layers | 90% VLDPE #1<br>10% ADDITIVE | 0.86 (layers 38 and 40 combined) |

The total thickness of the multilayer film in Table I is 4.5 mils. EAA is PRIMACOR 1410 (TM) ethylene/acrylic acid copolymer, obtained from The Dow Chemical Company, having a melt flow rate of 1.5 g/10 min and a density of 0.938 g/cm$^3$. VLDPE #1 is XUS 61520.15L™ linear very low density polyethylene, obtained from The Dow Chemical Company, having a melt flow rate of 0.5 g/10 min and a density of 0.9030 g/cm$^3$. ADDITIVE is L-7106-AB™ fluorescent brightening agent in low density polyethylene, obtained from Bayshore Industrial Inc. (a part of A. Schulman Masterbatches), having a melt flow rate of 4.50 g/10 min and a density of 0.9450 g/cm$^3$.

Figure 4:
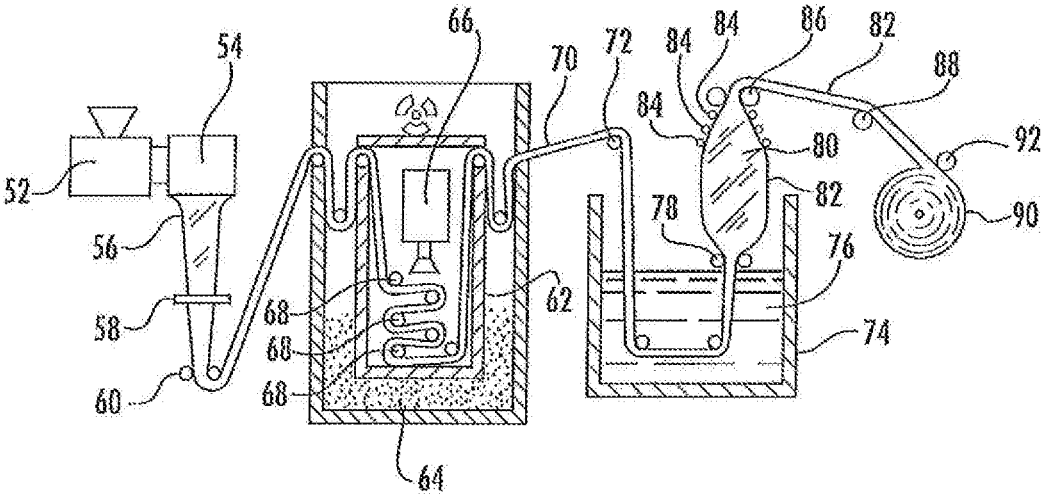
FIG. 4 PRIOR ART
FIG. 4 illustrates a schematic view of a prior art process for making a multilayer film for use in a patch of a patch bag.

FIG. 4 illustrates a schematic of an embodiment of a process for producing a multilayer film for use in a patch of a patch bag. In the process illustrated in FIG. 4, solid polymer beads (not illustrated) are fed to a plurality of extruders 52 (for simplicity, only one extruder is illustrated). Inside extruders 52, the polymer beads are forwarded, melted, and degassed, following which the resulting bubble-free melt is forwarded into die head 54, and extruded through annular die, resulting in tubing 56 which in some embodiments is 5-40 mils thick, in other embodiments 20-30 mils thick, and in yet other embodiments 25 mils thick.

After cooling or quenching by water spray from cooling ring 58, tubing 56 is collapsed by pinch rolls 60, and is thereafter fed through irradiation vault 62 surrounded by shielding 64, where tubing 56 is irradiated with high energy electrons (i.e., ionizing radiation) from iron core transformer accelerator 66. Tubing 56 is guided through irradiation vault 62 on rolls 68. In an embodiment, the irradiation of tubing 56 is at a level of from about 10 megarads ("MR").

After irradiation, irradiated tubing 70 is directed over guide roll 72, after which irradiated tubing 70 passes into hot water bath tank 74 containing hot water 76. The collapsed irradiated tubing 70 is submersed in the hot water for a retention time of at least about 5 seconds, i.e., for a time period in order to bring the film up to the desired temperature, following which supplemental heating means (not illustrated) including a plurality of steam rolls around which irradiated tubing 70 is partially wound, and optional hot air blowers, elevate the temperature of irradiated tubing 70 to a desired orientation temperature of from about 116° C.-121° C. An embodiment of a means for heating irradiated tubing 70 is with an infrared oven (not illustrated), by exposure to infrared radiation for about 3 seconds, also bringing the tubing up to about 116° C.-121° C. Thereafter, irradiated film 70 is directed through nip rolls 78, and bubble 80 is blown, thereby transversely stretching irradiated tubing 70. Furthermore, while being blown, i.e., transversely stretched, irradiated film 70 is drawn (i.e., in the longitudinal direction) between nip rolls 78 and nip rolls 86, as nip rolls 86 have a higher surface speed than the surface speed of nip rolls 78. As a result of the transverse stretching and longitudinal drawing, irradiated, biaxially-oriented, blown tubing film 82 is produced. Embodiments of the blown tubing are both stretched at a ratio of from about 1:1.5-1:6, and drawn at a ratio of from about 1:1.5-1:6. In embodiments, the stretching and drawing are performed at a ratio of from about 1:2-1:4. In embodiments, the result is a biaxial orientation of from about 1:2.25-1:36, or 1:4-1:16. While the bubble 80 is maintained between pinch rolls 78 and 86, blown tubing 82 is collapsed by rolls 84, and thereafter conveyed through nip rolls 86 and across guide roll 88, and then rolled onto wind-up roller 90. Idler roll 92 assures a good wind-up.

Referring to the film stock from which the bag is formed, embodiments of the film stock may have a total thickness of from about 1.5 to 5 mils. In embodiments, the stock film from which the bag is formed may be a multilayer film having from 3 to 7 layers, or 4 layers. Any suitable bag formulations, e.g., thermoplastic films, with or without oxygen barrier functionality) may be used for the bag. These films may be made by extrusion coating, co-extrusion, lamination, or other suitable processes. In some embodiments, the films include an outer layer, at least one intermediate layer, and an inner layer. The materials of the outer layer may be chosen for abuse resistance and/or sealability, and may be chosen from any suitable polymeric materials, e.g., polyolefins, polyesters, polyamides, and the like. The inner layer materials, often chosen for sealability, may be any of the materials described for the outer layer. The intermediate layer materials may be chosen for their barrier qualities (e.g., barriers to oxygen, moisture, carbon dioxide, etc.) and may include polyvinylidene chloride polymers and copolymers, ethylene vinyl alcohol copolymer, polyvinyl alcohol, polyamide, polyester, acrylonitrile, and the like. The bags may be heat-shrinkable, and the bags may be at least partially crosslinked.

Figure 5:
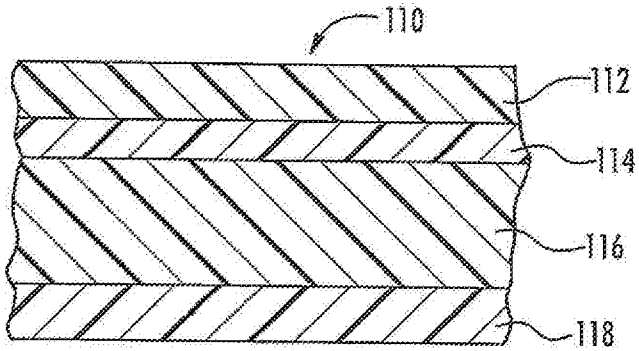
FIG. 5 PRIOR ART
FIG. 5 illustrates a cross-sectional view of a prior art multilayer film for use as an embodiment of a tubing film stock from which a bag is formed.

FIG. 5 illustrates a cross-sectional view of an embodiment of a multilayer film 110 for use as a film stock from which a bag is formed. Multilayer film 110 has a physical structure, in terms of number of layers, layer thickness, and layer arrangement and orientation in a bag, and a chemical composition in terms of the various polymers, etc. present in each of the layers, as set forth in Table II, below.

TABLE II

| Layer Designation | Layer Function | Layer Chemical Identity | Layer Thickness (mils) |
|---|---|---|---|
| 112 | Outside and abuse layer | 85% EVA #1<br>15% LLDPE #1 | 0.49 |
| 114 | $O_2$-Barrier layer | 100% PVDC/MA | 0.21 |
| 116 | Puncture-resistant layer | 70% LLDPE #2<br>30% EVA #2 | 1.03 |
| 118 | Sealant and inside layer | 60% VLDPE #2<br>40% LLDPE #3 | 0.28 |

EVA #1 is EB592AA™ ethylene/vinyl acetate copolymer containing less than 10 weight percent vinyl acetate comonomer, obtained from Westlake Chemical, having a melt flow rate of 2.0 g/10 min and a density of 0.931 g/cm$^3$. LLDPE #1 is DOWLEX® 2045.03 linear low density polyethylene, obtained from The Dow Chemical Company, having a melt flow rate of 1.1 g/10 min and a density of 0.9200 g/cm$^3$. PVDC/MA is SARAN® 806 vinylidene chloride/methyl acrylate copolymer, obtained from The Dow Chemical Company, having a density of 1.70 g/cm$^3$. LLDPE #2 is A-3282™ linear low density polyethylene, obtained from Westlake Chemical, having a melt flow rate of 1.0 g/10 min and a density of 0.917 g/cm$^3$. EVA #2 is ESCORENE® LD 713.93 ethylene/vinyl acetate copolymer, obtained from Exxon Mobil Corp, having a melt flow rate of 3.5 g/10 min and a density of 0.933 g/cm$^3$. VLDPE #2 is AFFINITY® PL 1281G1 branched very low density polyethylene, obtained from The Dow Chemical Company, having a melt flow rate of 6.0 g/10 min and a density of 0.9001 g/cm$^3$. LLDPE #3 is LL 3003.32™ linear low density polyethylene, obtained from Exxon Mobil Corp, having a melt flow rate of 3.2 g/10 min and a density of 0.918 g/cm$^3$.

Figure 6:
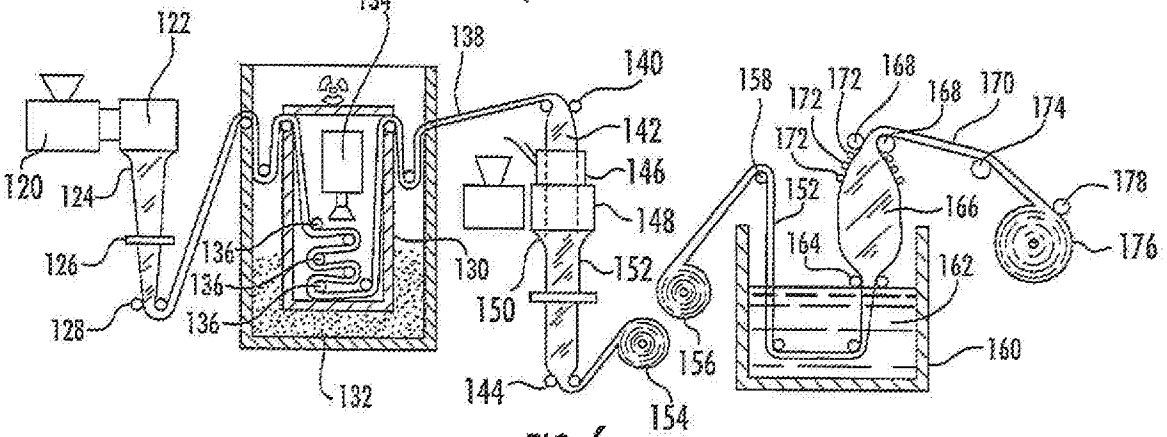
FIG. 6 PRIOR ART
FIG. 6 illustrates a schematic view of a prior art process for making a multilayer film for use as a tubing film stock.

The embodiment of the multilayer film for use as the tubing film stock described above may be used to form bags of both patchless bags and patch bags. Furthermore, the embodiment of the multilayer film described above may be formed as tubing film stock, FIG. 6 illustrates a schematic of an embodiment of a process for producing a multilayer film for use as a tubing film stock. In the process illustrated in FIG. 6, solid polymer beads (not illustrated) are fed to a plurality of extruders 120 (for simplicity, only one extruder is illustrated). Inside extruders 120, the polymer beads are forwarded, melted, and degassed, following which the resulting bubble-free melt is forwarded into die head 122, and extruded through an annular die. Embodiments of the resulting tubing 124 may be 10 to 30 mils thick, or 15 to 25 mils thick.

After cooling or quenching by water spray from cooling ring 126, tubing 124 is collapsed by pinch rolls 128, and is thereafter fed through irradiation vault 130 surrounded by shielding 132, where tubing 124 is irradiated with high energy electrons (i.e., ionizing radiation) from iron core transformer accelerator 134. Tubing 124 is guided through irradiation vault 130 on rolls 136. In an embodiment, tubing 124 is irradiated to a level of about 4.5 MR.

After irradiation, irradiated tubing 138 is directed through nip rolls 140, following which tubing 138 is slightly inflated, resulting in trapped bubble 142. However, at trapped bubble 142, the tubing is not significantly drawn longitudinally, as the surface speed of nip rolls 144 are about the same speed as nip rolls 140. Furthermore, irradiated tubing 138 is inflated only enough to provide a substantially circular tubing without significant transverse orientation, i.e., without stretching.

Slightly inflated, irradiated tubing 138 is passed through vacuum chamber 146, and thereafter forwarded through coating die 148. Second tubular film 150 is melt extruded from coating film 150 and coated onto slightly inflated, irradiated tube 138, to form two-ply tubular film 152. In an embodiment, second tubular film 150 includes an $O_2$-barrier layer, which does not pass through the ionizing radiation. Further details of the above-described coating step are generally as set forth in U.S. Pat. No. 4,278,738 (Brax et. al.), which is hereby incorporated, in its entirety, by reference thereto.

After irradiation and coating, two-ply tubing film 152 is wound up onto windup roll 154. Thereafter, windup roll 154 is removed and installed as unwind roll 156, on a second stage in the process of making the tubing film as ultimately desired. Two-ply tubular film 152, from unwind roll 156, is unwound and passed over guide roll 158, after which two-ply tubular film 152 passes into hot water bath tank 160 containing hot water 162. The now collapsed, irradiated, coated tubular film 152 is submersed in hot water 162 (having a temperature of about 99° C.) for a retention time of at least about 5 seconds, i.e., for a time period in order to bring the film up to the desired temperature for biaxial orientation. Thereafter, irradiated tubular film 152 is directed through nip rolls 164, and bubble 166 is blown, thereby transversely stretching tubular film 152. Furthermore, while being blown, i.e., transversely stretched, nip rolls 168 draw tubular film 152 in the longitudinal direction, as nip rolls 168 have a surface speed higher than the surface speed of nip rolls 164. As a result of the transverse stretching and longitudinal drawing, irradiated, coated biaxially-oriented blown tubing film 170 is produced. Embodiments of the blown tubing have been both stretched in a ratio of from about 1:1.5-1:6, and drawn in a ratio of from about 1:1.5-1:6. In embodiments, the stretching and drawing are each performed a ratio of from about 1:2-1:4. In embodiments, a biaxial orientation is about 1:2.25-1:36, or 1:4-1:16. While bubble 166 is maintained between nip rolls 164 and 168, blown tubing film 170 is collapsed by rolls 172, and thereafter conveyed through nip rolls 168 and across guide roll 174, and then rolled onto wind-up roll 176. Idler roll 178 assures a good wind-up. Thereafter, the obtained tubing film stock may be used to form the bag of patch bags and patchless bags.

The polymer components used to fabricate multilayer films may also contain appropriate amounts of other additives normally included in such compositions. These include antiblocking agents (such as talc), slip agents (such as fatty acid amides), fillers, pigments and dyes, radiation stabilizers (including antioxidants), fluorescent material (including at least one substance that fluoresces under ultraviolet radiation), antistatic agents, elastomers, viscosity-modifying substances (such as fluoropolymer processing aids) and the like additives known to those of skill in the art of packaging films.

Figure 7:
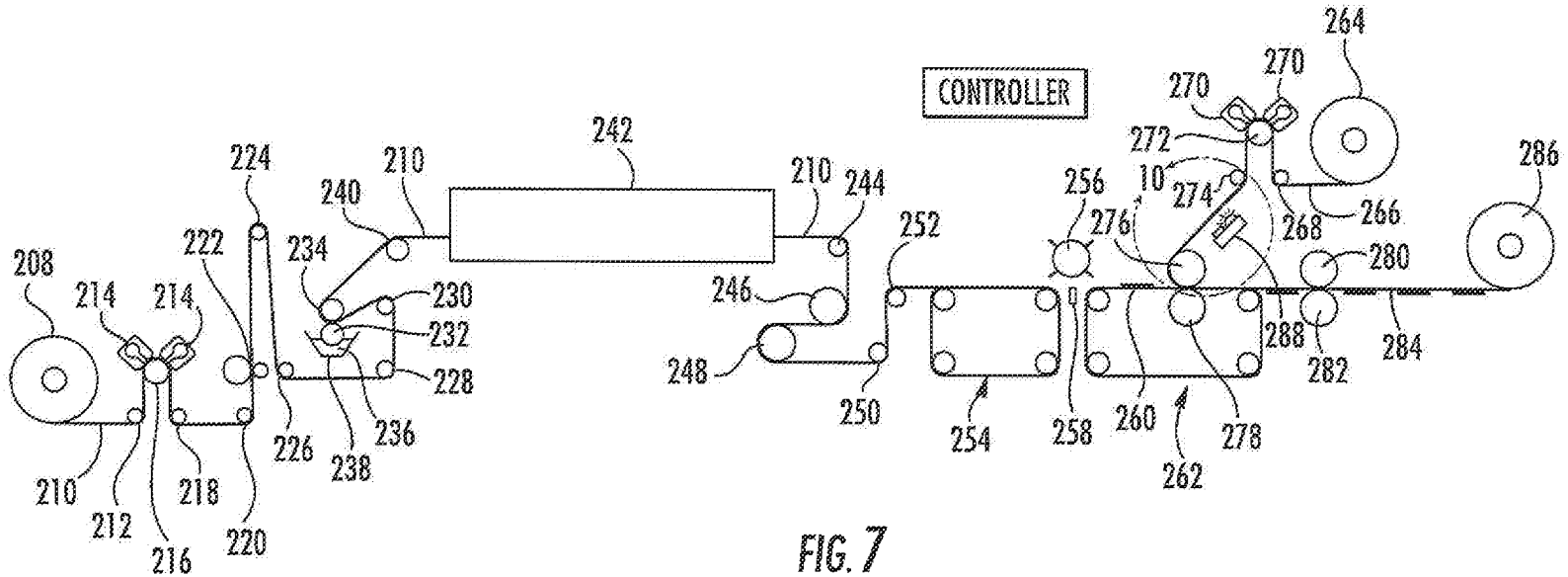
FIG. 7 illustrates a schematic view of a process for making a patch bag.

FIG. 7 illustrates a schematic representation of an embodiment of a process for manufacturing a patch bag, with a patch film roll 208 supplying patch film 210. The patch film 210 is directed, by idler roll 212, to corona treatment devices 214 which subject the upper surface of the patch film 210 to corona treatment as the patch film 210 passes over corona treatment roll 216. After corona treatment, patch film 210 is directed, by idler rolls 218 and 220, into (optional) printing roll 222.

Patch film 210 is thereafter directed over idler rolls 224, 226, 228, and 230, after which patch film 210 is passed between a small gap, i.e., a gap wide enough to accommodate patch film 210 passing therethrough, while receiving an amount of adhesive which corresponds with a dry coating, e.g., weight after drying of about 45 milligrams per 10 square inches of patch film, between adhesive application roll 232 and adhesive metering roll 234. Adhesive application roll 232 is partially immersed in adhesive 236 supplied to trough 238. As application roll 232 rotates counterclockwise, adhesive 236, picked up by the immersed surface of application roll 232, moves upward, contacts, and is metered onto, the full width of one side of patch film 210, moving in the same direction as the surface of application roll 232. Patch film 210 thereafter passes so far around adhesive metering roll 234 (rotating clockwise) that the adhesive-coated side of patch film 210 is in an orientation wherein the adhesive is on the top surface of patch film 210, as adhesive-coated patch film 210 moves between adhesive metering roll 234 and idler roll 240.

Thereafter, adhesive-coated patch film 210 is directed over drying oven entrance idler roll 240, and passed through oven 242 within which patch film 210 is dried to a degree that adhesive 236 on patch film 210 becomes tacky. Upon exiting oven 242, patch film 210 is directed partially around oven-exit idler roll 244, following which patch film 210 is cooled on chill rolls 246 and 248, each of which has a surface temperature of about 4-7° C., and a diameter of about 12 inches. The cooling of patch film 210 is carried out in order to stabilize patch film 210 from further shrinkage.

Thereafter, patch film 210 is directed, by idler rolls 250 and 252, by pre-cutting vacuum conveyor assembly 254, and thereafter forwarded to a rotary scissor-type knife having upper rotary blade assembly 256 and lower blade 258, which cuts across the width of patch film 210 in order to form patches 260. Patches 260 are forwarded and held on a belt of post-cutting vacuum conveyor assembly 262. While patches 260 are held on the belt of post-cutting vacuum conveyor assembly 262, tubing-supply roll 264 supplies tubing film stock 266, which is directed by idler roll 268, to corona treatment devices 270 which subject the upper outside surface of the tubing film stock 266 to corona treatment as the tubing film stock 266 passes over corona treatment roll 272. After corona treatment, the tubing film stock 266 is directed, by idler roll 274, partially around the surface of upper pre-lamination nip roll 276, and through the nip between upper pre-lamination nip roll 276 and lower pre-lamination nip roll 278, the pre-laminating nip rolls being above and below the post-cutting vacuum conveyor belt 262. Pre-lamination nip rolls 276 and 278 position patches 260 onto the now lower, corona-treated outside surface of the tubing film stock 266. After passing through the nip between pre-lamination nip rolls 276 and 278, the tubing film stock 266, having patches 260 laminated intermittently thereon, exits off the downstream end of the post-cutting vacuum conveyor assembly 262, and is directed through the nip between upper laminating nip roll 280 and lower laminating nip roll 282, these rolls exerting pressure (about 75 psi) in order to secure patches 260 to the tubing film stock 266, to result in patch-laminated tubing film stock 284. Thereafter, the patch-laminated tubing film stock 284 is wound up to form rewind roll 286, with rewind roll 286 having the laminated patches thereon oriented towards the outer-facing surface of the patch-laminated tubing film stock 284.

If it is desirable to produce patch bags including only a single patch adhered to each patch bag, the patch-laminated tubing film roll 286 may be cut into individual patch bags including single patches adhered thereto.

Figure 8:
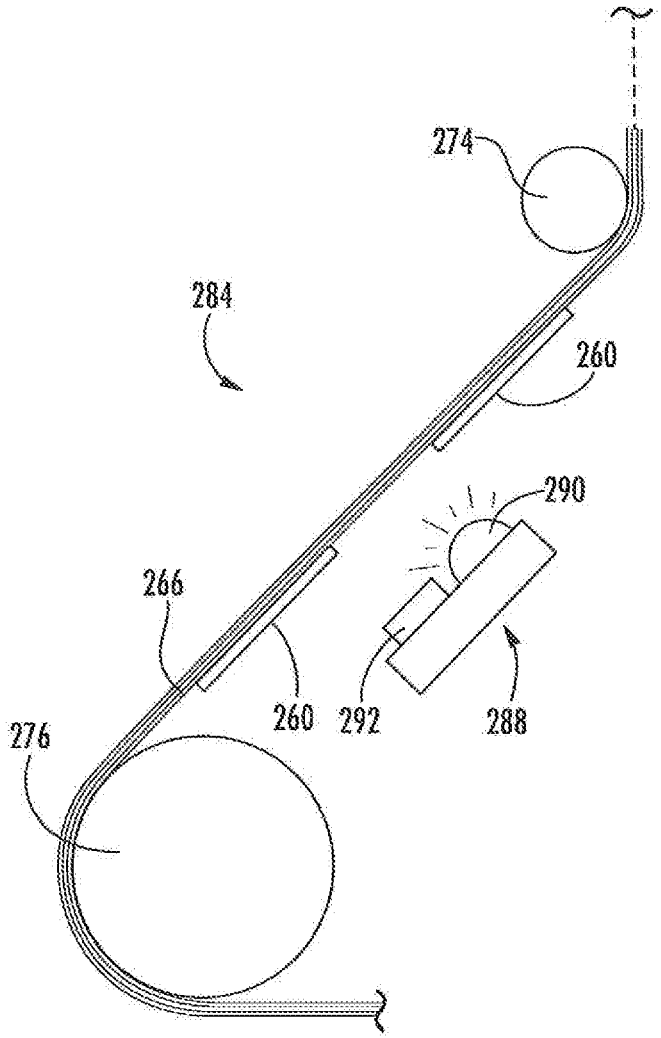
FIG. 8 illustrates an enlarged view of a portion of the process illustrated in FIG. 7.

However, if it is desirable to produce patch bags including two patches adhered thereto, the roll 286 may be removed from its winder and positioned in the place of tubing supply roll 264, and the process of FIG. 7, described immediately above, may be repeated. FIG. 8 illustrates an enlarged view of a section of FIG. 7 that is encircled with a dashed line, where the patch-laminated tubing film stock 284 is being advanced from the idler roll 274 to the nip roll 276 and past a fluorescence sensing apparatus 288 including a radiation emitter and a fluorescence detector. In FIGS. 7 and 8, the radiation emitter includes a LED 290 that emits ultraviolet radiation, and the fluorescence detector includes a fluorescence detecting camera 292. As the patch-laminated tubing film stock 284 is advanced past the LED 290, the LED 290 irradiates the patches 260 adhered to the tubing film stock 266. The patches may include a fluorescent material that is excited when irradiated with ultraviolet radiation. When the fluorescent material in the patches is excited, the fluorescent material emits fluorescence. As the patch-laminated tubing film stock 284 is further advanced past the fluorescence detecting camera 292, the camera 292 detects the fluorescence that is emitted from the patches within an interrogating view of the camera.

FIG. 8 is a schematic illustration of an embodiment showing a cross section of two sides of the tubing film stock 266 with patches 260 adhered to one side of the tubing film stock.

In the embodiment that is illustrated in FIGS. 7 and 8, when a leading edge of a patch 260 is detected by camera 292, the camera acquires information regarding the location of the leading edge of the patch, relative to the position of the patch-laminated tubing film stock 284 being advanced from the idler roll 274 to the nip roll 276. The camera transmits the information to a controller. The controller then controls the advancement of the patch film 210 on the pre-cutting vacuum conveyor assembly 254 toward the upper rotary blade assembly 256 and lower blade 258, and the controller controls the cutting of another patch 260 from the patch film 210. The controller then controls the advancement of the cut patch 260 on the vacuum conveyor assembly 262 to a position between the upper pre-lamination nip roll 276 and lower pre-lamination nip roll 278. The controller controls the advancement of the leading edge of the cut patch 260 on the vacuum conveyor assembly 262 to the position between the upper pre-lamination nip roll 276 and lower pre-lamination nip roll 278 so that the leading edge of the cut patch 260 contacting the vacuum conveyor assembly 262 is aligned with the leading edge of the patch on the opposite side of the patch-laminated tubing film stock 284, which was detected by the fluorescence sensing apparatus 288. After passing through the nip between pre-lamination nip rolls 276 and 278, the patch-laminated tubing film stock 284, having patches 260 aligned and contacting both sides, exits off the downstream end of the post-cutting vacuum conveyor assembly 262, and is directed through the nip between upper laminating nip roll 280 and lower laminating nip roll 282, to secure the cut patch 260 thereon and produce two-patch tubing film stock. Therefore, the two-patch tubing film stock may include a series of patches 260 adhered to both sides such that the leading edges of the patches on one side of the tubing film stock are aligned in any desired manner relative to the leading edges of patches on the opposite side of the tubing film stock.

However, in embodiments, the fluorescence detector detects a position of a leading edge of a patch, a position of a trailing edge of a patch, positions of both leading and trailing edges of patches, etc.

In an embodiment, the two-patch tubing film stock includes a series of patches adhered to both sides such that the trailing edges of the patches on one side of the tubing film stock are aligned with trailing edges of patches on the opposite side of the tubing film stock.

Furthermore, in an embodiment, the two-patch tubing film stock includes a series of patches adhered to both sides such that both the leading edges and the trailing edges of the patches on one side of the tubing film stock are respectively aligned with both the leading edges and the trailing edges of patches on the opposite side of the tubing film stock.

An embodiment of a method of manufacturing a patch bag, which may be carried out on the above-described apparatus, includes adhering a first patch including a fluorescent material to a first portion of film stock, advancing the film stock with the first patch adhered thereto past a radiation emitter, e.g. LED 290, and a fluorescence detector, e.g., fluorescence detecting camera 292, wherein the radiation emitter irradiates the first patch adhered to the film stock to excite the fluorescent material, detecting a position of the first patch, e.g., a position of a leading edge or a trailing edge of the first patch, on the film stock by interrogating fluorescence emitted by the fluorescent material using the fluorescence detector, acquiring information from detecting a position of the first patch, transmitting the information to a controller, aligning a second patch with the position of the first patch, using the controller, and adhering the second patch to a second portion of the film stock on an opposite side of the film stock from the first portion, while the second patch is aligned with the position of the first patch.

In an embodiment, patches are adhered to opposite sides of tubing film stock, so that the patches adhered to opposite sides of the tubing film stock are aligned, as discussed above. Patch bags may be cut from the tubing film stock by sealing across a width of the tubing film stock and severing the tubing film stock into patch bags, such that each patch bag has an end-seal and two patches adhered to opposite sides thereof.

In another embodiment, patches are adhered to only one side of tubing film stock, and patch bags are cut from the tubing film stock by sealing across a width of the tubing film stock and severing the tubing film stock into patch bags, such that each patch bag has an end-seal and one patch adhered thereto.

Figure 9:
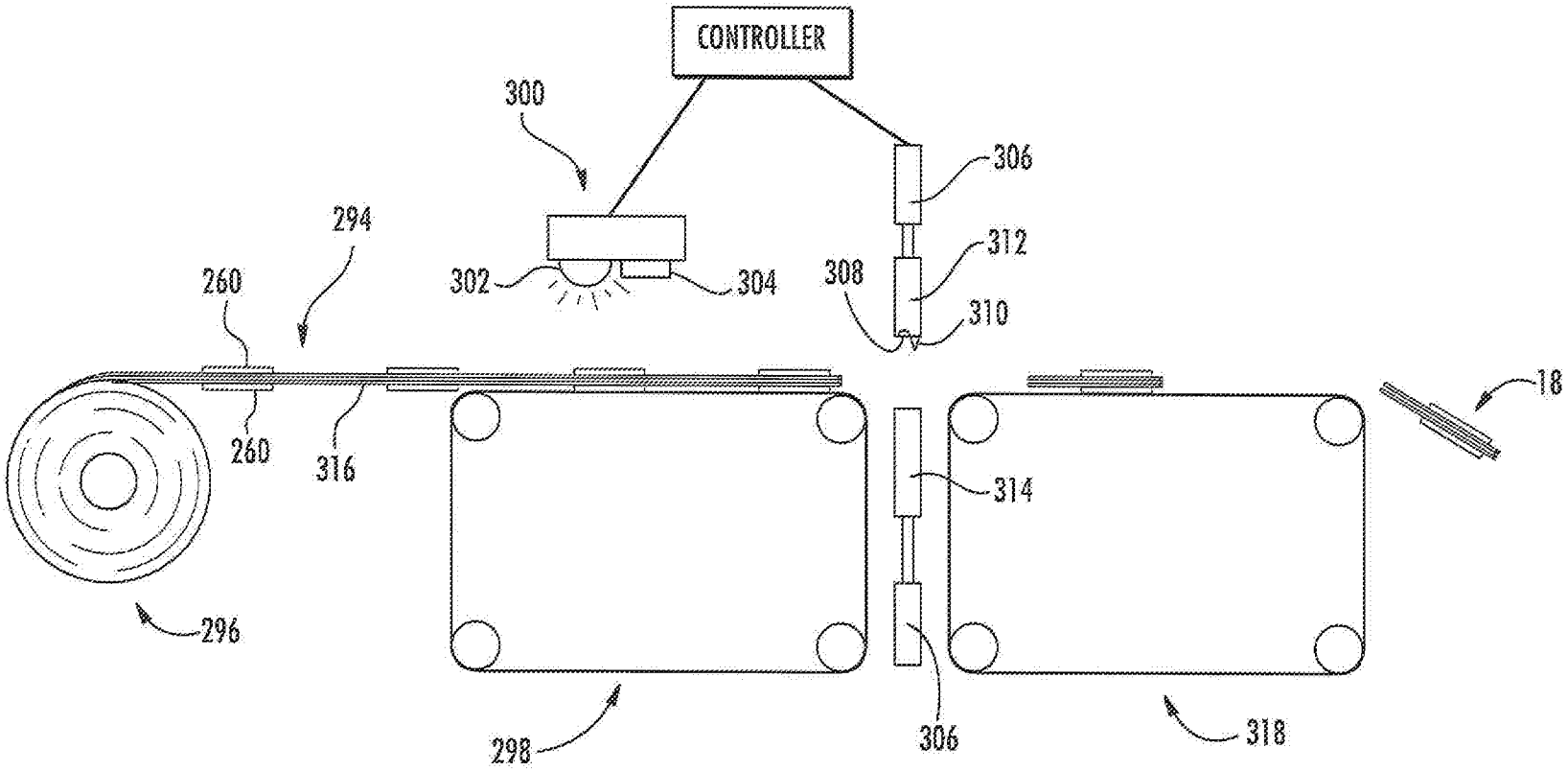
FIG. 9 illustrates a schematic view of a process for making a patch bag.

FIG. 9 is a schematic illustration of an embodiment showing a cross-section of two sides of two-patch tubing film stock 294 with patches 260 adhered to both sides of the two-patch tubing film stock. In the embodiment that is illustrated in FIG. 9, the two-patch tubing film stock 294 is converted to patch bags 18, as follows. The two-patch tubing film stock 294 is wound off a roll 296 and onto a first cutting vacuum conveyor 298. The first cutting vacuum conveyor 298 advances the two-patch tubing film stock 294 past a fluorescence sensing apparatus 300 including a radiation emitter and a fluorescence detector. In FIG. 9, the radiation emitter includes a LED 302 that emits ultraviolet radiation, and the fluorescence detector includes a fluorescence detecting camera 304. The LED 302 irradiates the patches 260 and excites the fluorescent material that is included the patches. When the fluorescent material in the patches is excited, the fluorescent material emits fluorescence. The patches 260 are spaced apart along the two-patch tubing film stock 294, such that gaps 316 are between the patches 260. As the first cutting vacuum conveyor 298 further advances the two-patch tubing film stock 294 past the fluorescence detecting camera 304, the fluorescence detecting camera 304 detects a leading edge of at least one patch of a pair of aligned patches adhered to both sides of the tubing film stock, by detecting fluorescence that is emitted by the fluorescent material within an interrogating view of the camera 304. The camera acquires information regarding the position of the leading edge of at least one patch of a pair of aligned patches, and sends the information to a controller. The controller controls the advancement of the two-patch tubing film stock 294 on the first cutting vacuum conveyor 298 to a cutting and sealing apparatus 306, including a head 312 with a sealer 308 and a blade 310. The controller controls the cutting and sealing apparatus 306 so that the head 312 is pressed downward against a base 314 of the sealing apparatus. The controller controls the positioning of the leading edge of at least one patch of a pair of aligned patches so that a factory seal is formed by the sealer 308 at a position within the gap 316 and just downstream of the leading edges of the patches on the tubing film stock. The controller also controls the blade 310 to sever the tubing film stock within the gap 316 at a position downstream of the seal. The severance of the tubing film stock forms a patch bag 18, which is then conveyed away from the cutting and sealing apparatus 306 by a second cutting vacuum conveyor 318.

When a factory seal is formed between patches spaced apart along a length of tubing film stock, the seal may be formed a distance, e.g., $5/16^{th}$ of an inch, 1 inch, etc., from an edge of a patch. Immediately following the formation of the factory seal, the tubing may be cut completely across, and completely through both sides of the tubing, with the seal between the edge of the patch and the cut. For example, when forming the seal 1 inch from the edge of the patch, the cut may be made at a position about 0.75 inches from the seal and about 1.75 inches from the edge of the patch. However, it should be noted that a seal may be made through patches, as taught by U.S. Pat. No. 7,670,657.

In some embodiments, both the seal and the cut through the tubing film stock are made in a gap between patches that are spaced apart along the length of the tubing film stock. In an embodiment, the seal and the cut are made adjacent to leading edges of the patches, in the direction that the patches are fed toward cutting and sealing mechanisms, such that the seal is formed between the cut and the leading edge of the patch. In an embodiment, the seal and the cut are made adjacent to trailing edges of the patches such that the seal are formed between the cut and the trailing edge of a patch. In embodiments, the seal and cut are made through the patches and the tubing film stock, at positions adjacent either trailing edges or leading edges of patches, and the cut is made closer to the edges of the patches than the seal.

An embodiment of a method of manufacturing a patch bag, which may be carried out on the above-described apparatus, includes advancing film stock past a radiation emitter, e.g. LED 302, and a fluorescence detector, e.g., fluorescence detecting camera 304, such that the radiation emitter irradiates patches spaced apart along a longitudinal direction of the film stock and adhered to the film stock to excite a fluorescent material included in the patches, detecting an edge of a patch of the patches adhered to the film stock by interrogating fluorescence emitted from the fluorescent material using the fluorescence detector, acquiring information from detecting the edge of the patch of the patches, transmitting the information to a controller, forming a seal across a width of the film stock at a first position adjacent to the edge of the patch of the patches, severing the film stock, across the width of the film stock, at a second position adjacent to the edge of the patch of the patches to form the patch bag. The seal may be formed before or after the severing the film stock.

After the manufacture of patch bags and patchless bags, the bags may be loaded with a product, e.g., a meat product or a cheese product, and fed to a vacuum chamber.

When a loaded patch bag or a loaded patchless bag is fed into a vacuum chamber, often a trailing edge of the bag includes an open bag mouth, such that the trailing edge of the bag and the bag mouth is positioned upstream with respect to the direction that the bag is fed into the vacuum chamber. When a bag is loaded with a product such as a piece of meat or cheese, the trailing edge of the bag and the bag mouth may extend further upstream from the trailing edge of the product, with respect to the direction that the bag is fed into the vacuum chamber, so that the bag may be sealed between the trailing edge of the product and the bag mouth. Also, when a loaded patch bag is fed into a vacuum chamber, a trailing edge of a patch may be located upstream with respect to the direction that the patch bag is fed into the vacuum chamber. When a product is inserted into a patch bag, a trailing edge of the patch may extend a distance further upstream from the trailing edge of the product, the trailing edge of the product may extend a distance further upstream from the trailing edge of the patch, the trailing edge of the patch and the trailing edge of the product may be at the same or substantially the same position, etc. In an embodiment of heat sealing a patch bag, the bag may be sealed between the bag mouth and the trailing edge of the patch, and not through the patch. Furthermore, in embodiments of heat sealing either a patch bag or a patchless bag, the bag is sealed through a portion of the patch bag or the patchless bag where the product does not reside, because the product obstructs the formation of the seal. However, a seal may be made through a patch.

The content of U.S. Pat. No. 7,296,390 (Koke et al.) is incorporated herein by reference in its entirety. U.S. Pat. No. 7,296,390 is entitled vacuum packaging machine having a plurality of vacuum chambers for performing a vacuum sealing operation on product packages.

Figure 10:
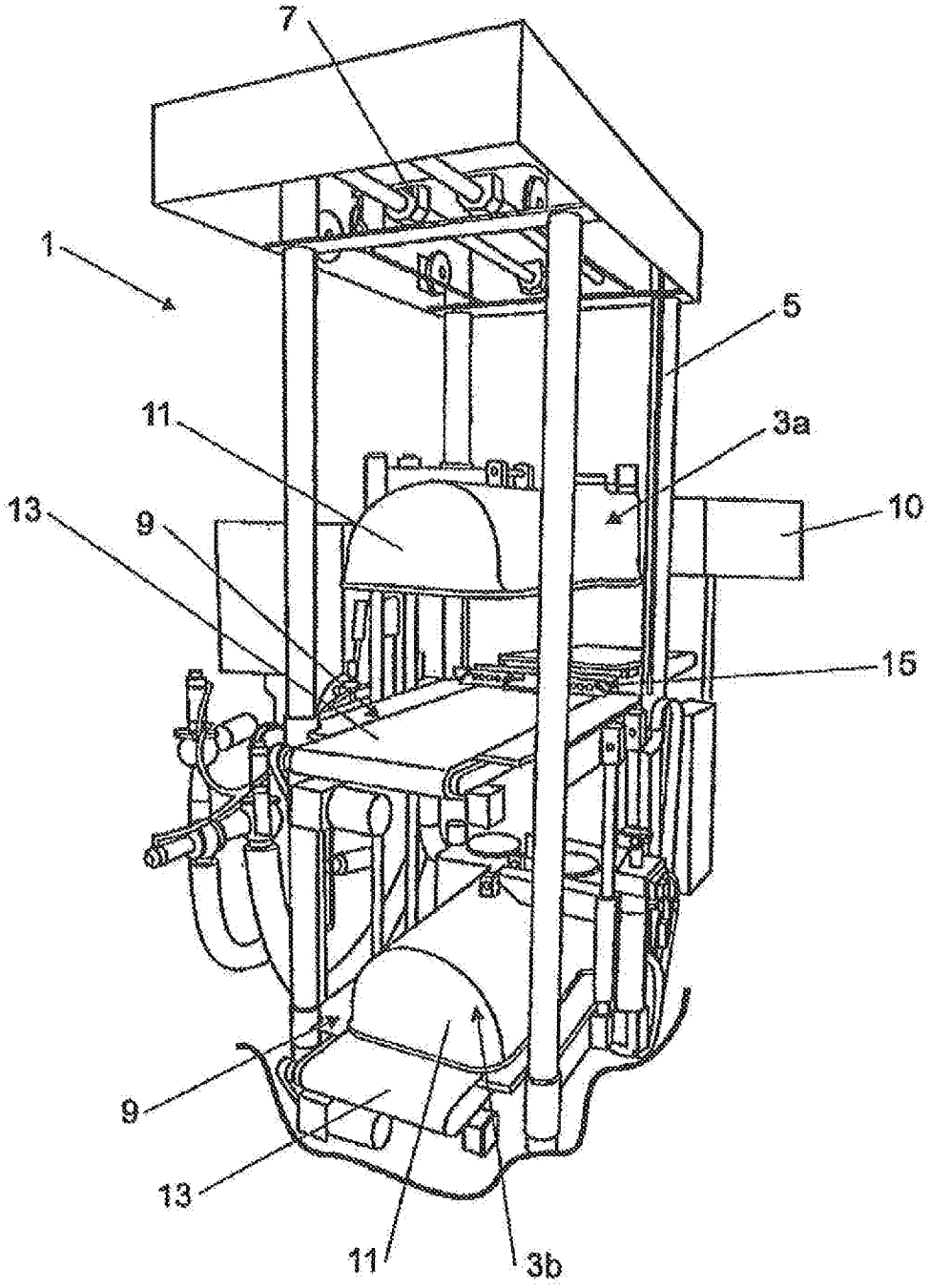
FIG. 10 PRIOR ART
FIG. 10 is a perspective view of a prior art vacuum packaging machine.
Figure 11:
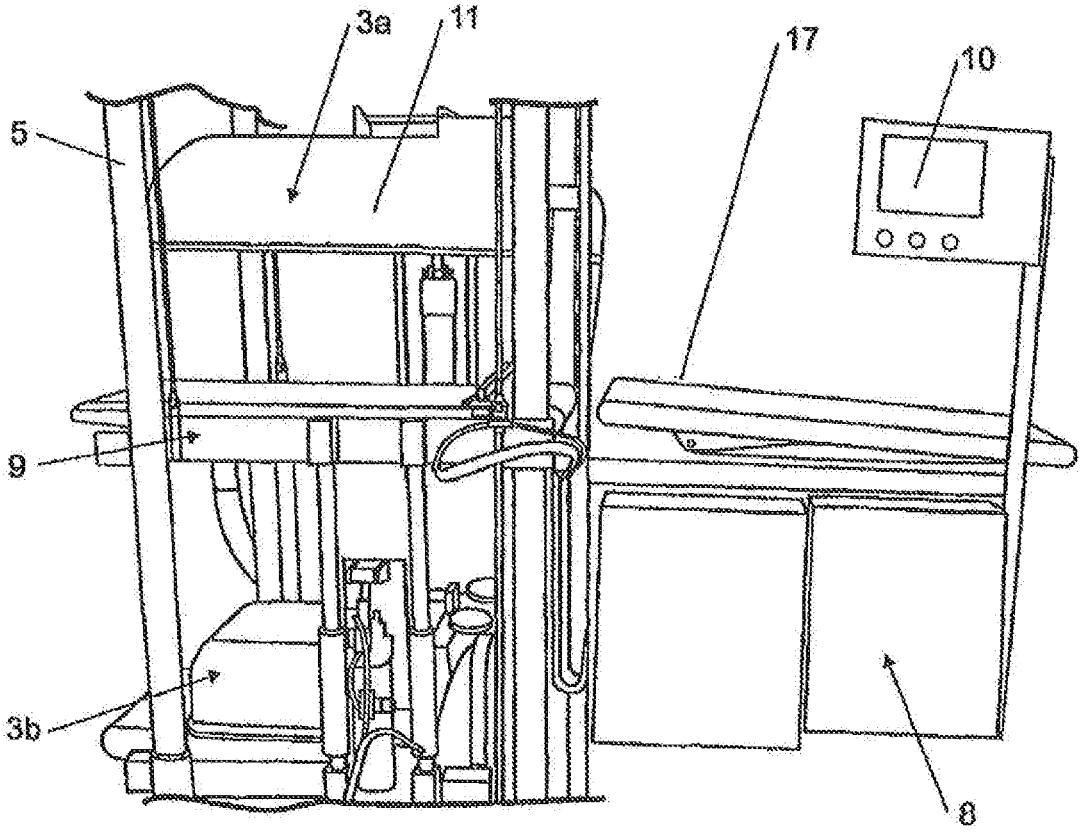
FIG. 11 PRIOR ART
FIG. 11 is a side elevational view of a prior art vacuum packaging machine.
Figure 12:
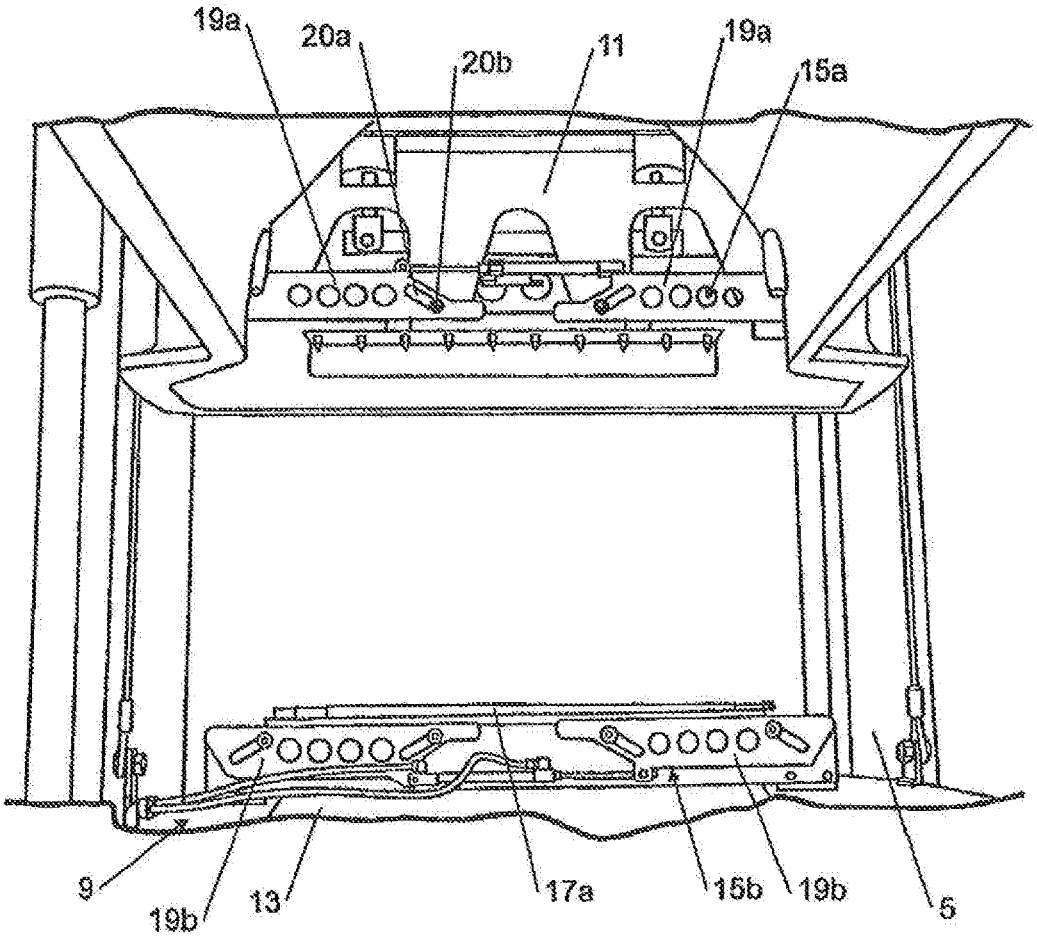
FIG. 12 PRIOR ART
FIG. 12 is a view of the interior of a prior art vacuum chamber, showing a heat seal assembly.
Figure 13:
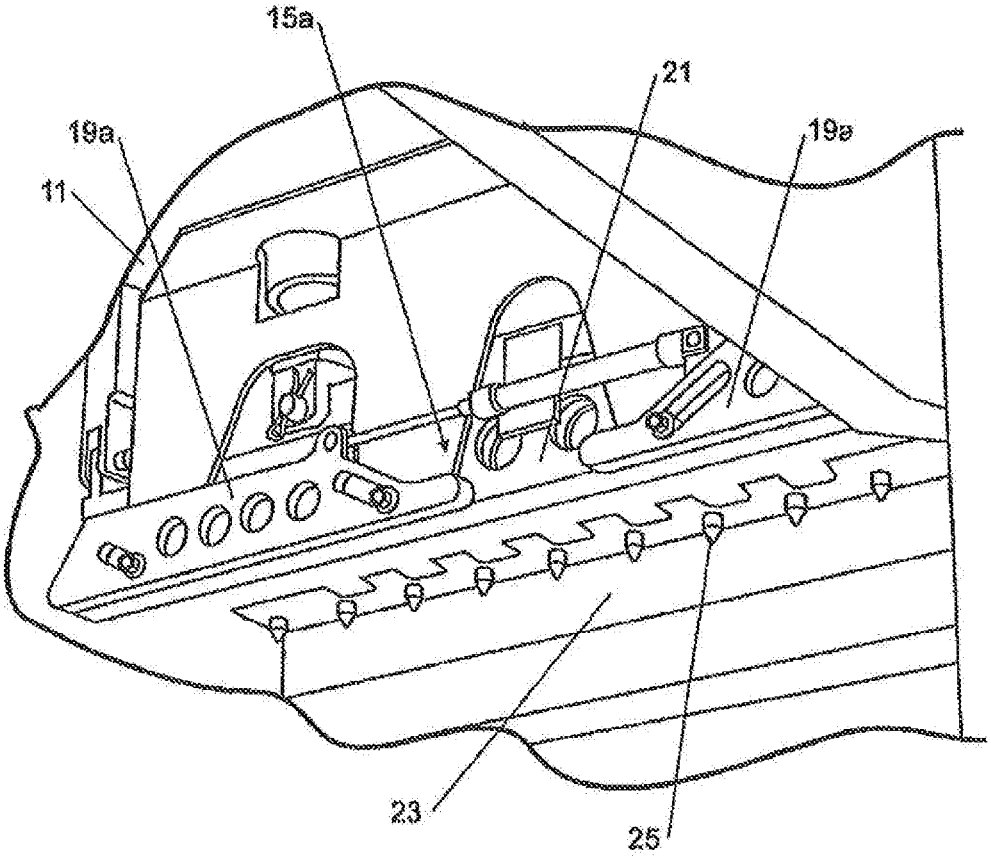
FIG. 13 PRIOR ART
FIG. 13 is a perspective view of the upper interior of a vacuum chamber, showing the details of the upper part of the heat seal assembly of FIG. 12.
Figure 14:
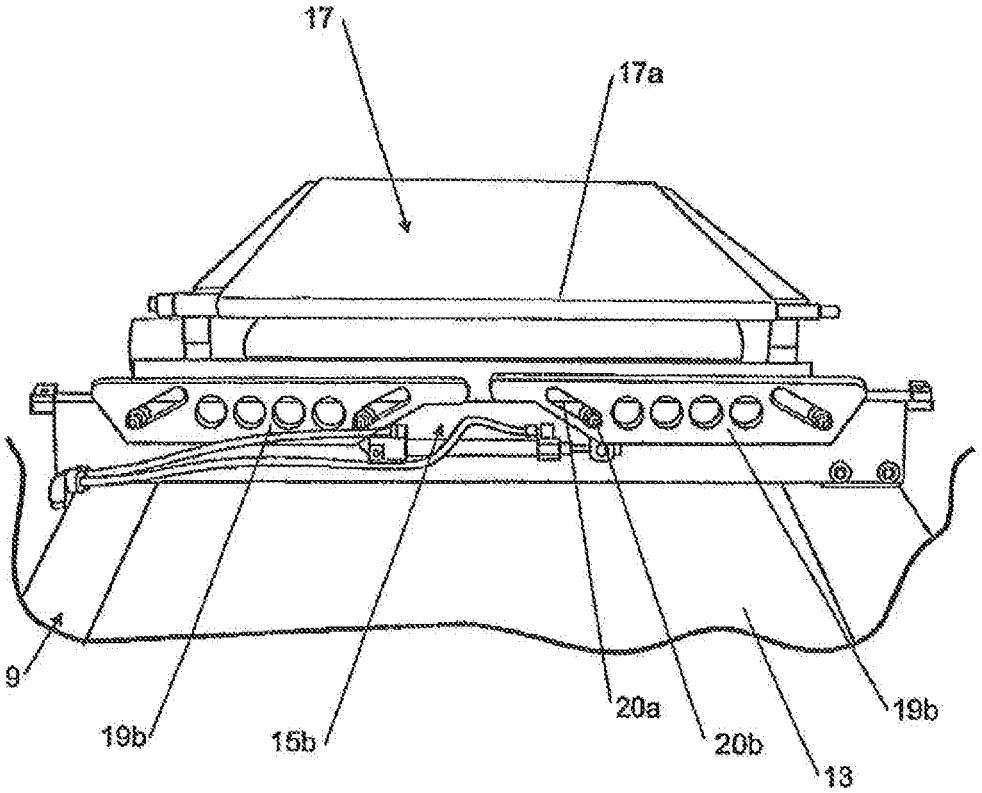
FIG. 14 PRIOR ART
FIG. 14 is a view of the lower part of a vacuum chamber, showing details of a lower part of the heat seal assembly of FIG. 12.
Figure 15:
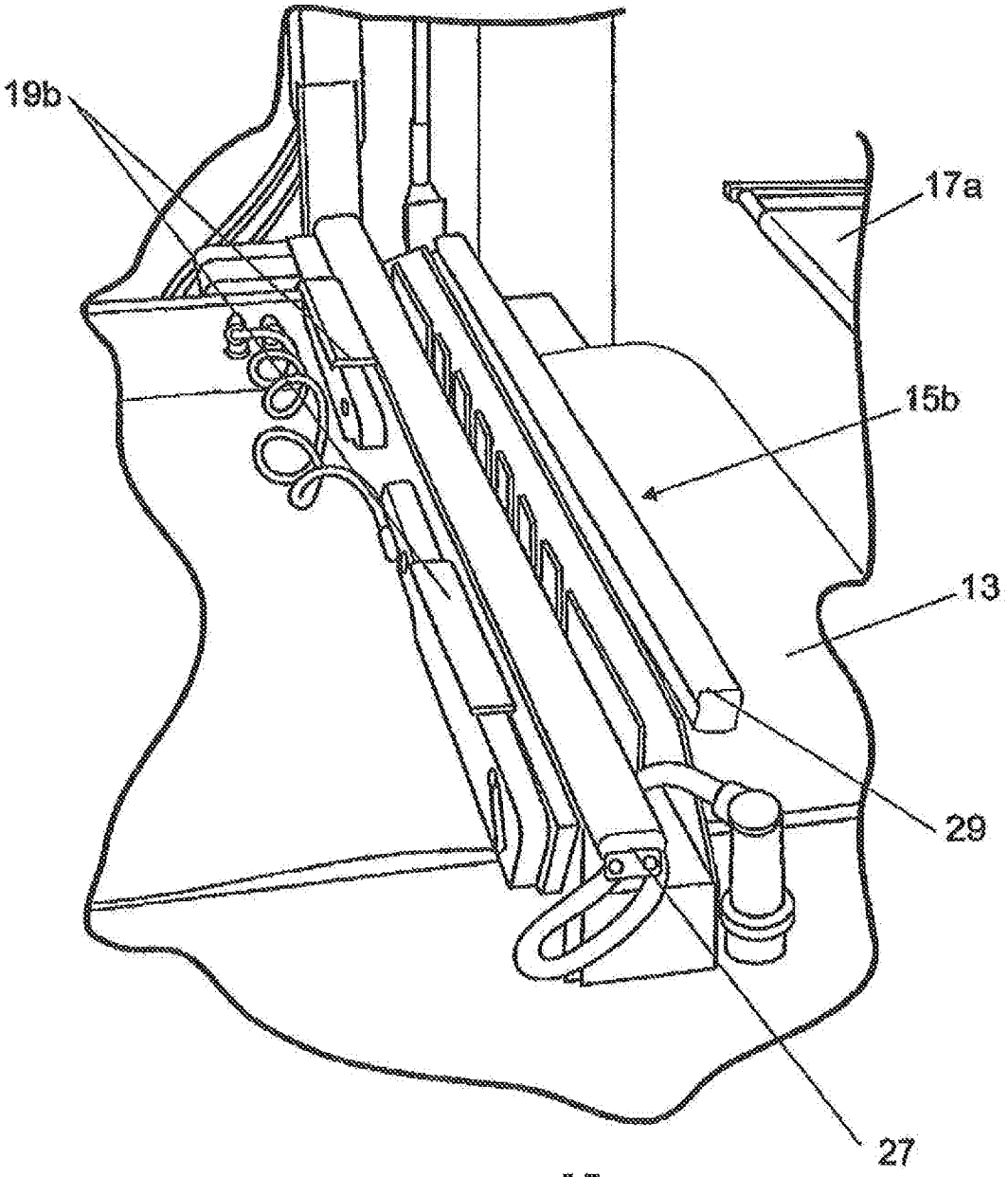
FIG. 15 PRIOR ART
FIG. 15 is a perspective view of the lower part of the heat seal assembly of FIG. 12.

With reference to FIGS. 10 and 11, an embodiment of a vacuum packaging machine is indicated generally by reference numeral 1. The vacuum packaging machine includes upper and lower vertically stacked vacuum chambers 3*a*, 3*b*, which are vertically moveably mounted between columns 5. Mounted adjacent the tops of the columns 5 is a drive mechanism 7 for the vacuum chambers 3*a*, 3*b*.

An electronic control system 8 controls operation of the machine 1, and a keypad/monitor 10 is provided to enable a user to program the control system.

Each vacuum chamber 3*a*, 3*b* includes a bed 9 and a chamber hood 11. The beds 9 are synchronously vertically movably mounted between the columns 5, and each chamber hood 11 is vertically moveable relative to the respective bed 9. The chamber hoods 11 are moved via any suitable motive device, e.g., pneumatic rams, hydraulic rams or mechanical drive devices.

Each vacuum chamber has a heat seal assembly 15 therein, described below with reference to FIGS. 12 to 15. The bed 9 of each vacuum chamber includes an internal conveyor 13 to convey packaged product out of the chamber after it has been vacuum sealed, the direction of travel of the conveyor 13 defining a longitudinal direction of the vacuum chamber.

With reference to the embodiment of the vacuum packaging machine shown in FIGS. 10 and 11, a vacuum packaging machine conveyor arrangement may be provided to feed/unload loaded bags to/from the vacuum chambers. The conveyor arrangement may include an infeed conveyor 17 to feed loaded bags into the vacuum chambers.

A second conveyor (discussed below) may be positioned between the infeed conveyor and the internal conveyor. Furthermore, a placement conveyor (discussed below) may be positioned to feed loaded bags onto an upstream end of the infeed conveyor, with respect to the direction that a loaded bag is advanced to the vacuum chamber. In addition, an outfeed conveyor may also be provided to remove a sealed loaded bag from the machine following sealing.

The vacuum chambers are moveable together between a lower position (shown in FIGS. 10 and 11) wherein the upper chamber 3*a* is adjacent the infeed conveyor 17 for feeding and unloading, and an upper position (not shown) wherein the bed of the lower chamber 3*b* is adjacent the infeed conveyor 17 for feeding and unloading. While one of the vacuum chambers is in the feeding/unloading position, the other chamber is in an operating position to perform a vacuum sealing operation on the loaded bag contained therein. Therefore, the operating position for the upper vacuum chamber 3*a* is above the level of the infeed conveyor, while the operating position for the lower vacuum chamber 3*b* is below the level of the infeed conveyor.

As can be seen from the embodiment that is illustrated in FIGS. 12 to 15, the heat seal assembly 15 in each vacuum chamber includes an upper part 15*a* and a lower part 15*b*. The heat seal assembly 15 extends transversely to the longitudinal direction of the vacuum chamber, and therefore to the direction of travel of loaded bags through the chamber. This enables the loaded bag to be delivered to the vacuum chamber with its unsealed portion trailing, which is the orientation in which the loaded bag would exit from prior bagging/wrapping stations.

The upper part 15*a* of the heat seal assembly includes a pair of upper spreaders 19*a*, a heat seal anvil 21, a puncturing device having a plurality of piercing knives (not shown), and a clamping device 23 having a series of clamping pins 25. The lower part 15*b* of the heat seal assembly includes a pair of lower spreaders 19*b* which are complementary to the pair of upper spreaders 19*a*, a heat seal bar 27, and a lower clamp bar 29. It will be appreciated that the anvil could be provided in the lower part 15*b* of the heat seal assembly, with the heat seal bar provided in the upper part 15*a* of the heat seal assembly.

In this embodiment, the spreading operation is as follows. The spreaders 19*a*, 19*b* are operable to grip and spread the unsealed part of the loaded bag prior to heat sealing. As will be apparent from the figures, as the upper 19*a* and lower 19*b* spreaders are brought together, they move outwardly by virtue of the angled slots 20*a* and pins 20*b* extending therethrough. The spreaders function in a similar way to those described in U.S. Pat. No. 6,877,543 (Stevens), the content of which is incorporated herein by reference in its entirety.

The clamping pins 25 and lower clamp bar 29 (which would generally be made from a resilient material such as rubber) maintain the unsealed portion of the package in the spread configuration, and provide tension on the loaded bag such that it can be pierced. When the puncturing device is actuated, the knives (not shown) pierce the package. The puncturing device forms small apertures in the loaded bag. During feeding of the loaded bag into the vacuum chamber, it is feasible that the trailing unsealed portion of the loaded bag may be located such that it will be clamped under the end wall of the vacuum chamber hood 11 when it is closed. The apertures formed by the puncturing device ensure that any air in the loaded bag may still be evacuated if this should occur.

The heat seal anvil 21 is operable to push against the heat seal bar 27 with the unsealed portion of the loaded bag therebetween, while applying a current to the heat seal bar and sealing the loaded bag.

Although not shown in the figures, a suitable cutting device is provided to cut the loaded bag between the heat seal bar 27 and the puncturing device. An example of a cutting device is a serrated knife, which is arranged to move downwards from above to shear the loaded bag.

The belt of the internal conveyor 13 may extend under the lower part of the heat seal assembly 15*b*, and around the outer ends of the bed 9 of the vacuum chamber. For this purpose, the surface of the conveyor belt includes a smooth surface (relative to a conventional cloth surface), for example a smooth elasticized surface, such that the vacuum chamber can seal over the belt.

In order to deliver the loaded bag over the lower part 15*b* of the heat seal assembly, the infeed conveyor 17 has in one embodiment a telescoping portion 17*a*. During feeding the loaded bag into an open vacuum chamber, the telescoping portion 17*a* extends over the lower part 15*b* of the heat seal assembly, and is operated to drop the body of the loaded bag onto the conveyor 13 on the bed 9 of the vacuum chamber. The trailing unsealed portion of the loaded bag will remain located on the telescoping portion 17*a* of the infeed conveyor. As the telescoping portion 17*a* is retracted away from the vacuum chamber so that the vacuum chamber can be moved and closed, the trailing unsealed portion of the loaded bag will drop onto the lower part 15*b* of the heat seal assembly, so that the unsealed portion can be spread and sealed. The heat seal assembly 15 is relatively low profile to minimize the product drop distance as the telescoping portion 17*a* of the conveyor is extended into the vacuum chamber.

In another embodiment, a vacuum packaging machine includes two or more vacuum chambers positioned in a horizontal arrangement (hereinafter vacuum packaging machine comprising horizontally arranged vacuum chambers), as follows. In the horizontal arrangement, the vacuum chambers are positioned laterally across a support, such as a floor. An infeed conveyor, a second conveyor, and/or a placement conveyor may be movable between the two or more vacuum chambers, in order to feed loaded patch bags and/or loaded patchless bags into the vacuum chambers. The vacuum chambers are each configured to receive a respective unsealed loaded bag and perform a vacuum sealing operation on the loaded bag. A path of travel of a loaded bag through the vacuum chambers defines a longitudinal direction of the vacuum chambers. Each of the vacuum chambers includes a heat seal assembly, disposed transversely to the longitudinal direction of vacuum chamber, for forming a heat seal across a bag mouth of a respective loaded bag.

The contents of U.S. Pat. No. 3,958,391 (Kujubu), U.S. Pat. No. 4,580,393 (Furukawa), and U.S. Pat. No. 4,640,081 (Kawaguchi et al.) are incorporated herein by reference in their entirety. U.S. Pat. No. 3,958,391 (Kujubu), U.S. Pat. No. 4,580,393 (Furukawa), and U.S. Pat. No. 4,640,081 (Kawaguchi et al.) disclose rotary vacuum packaging machines.

Figure 16:
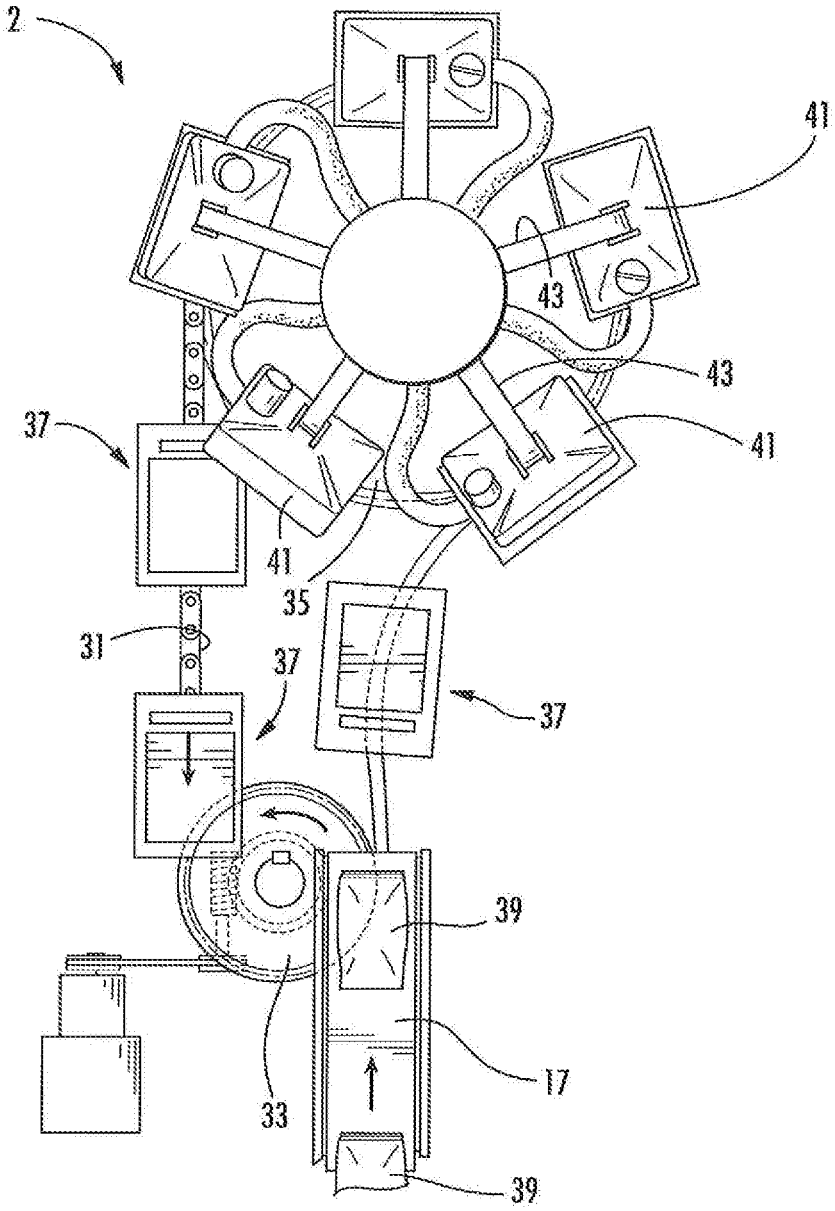
FIG. 16 PRIOR ART
FIG. 16 is a plan view of a prior art rotary vacuum packaging machine.
Figure 17:
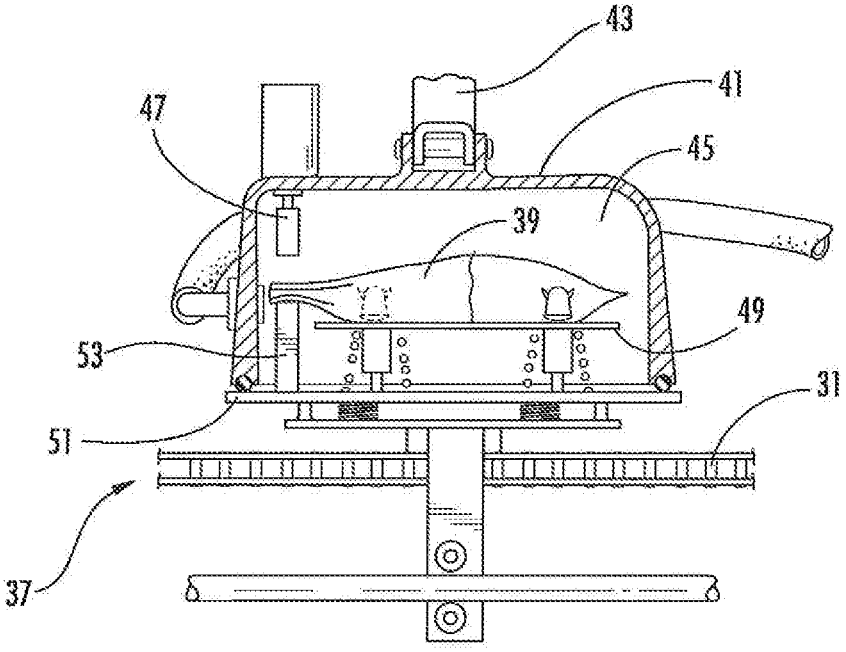
FIG. 17 PRIOR ART
FIG. 17 is a side elevational view of a supporting device of the prior art rotary vacuum packaging machine of FIG. 16.

FIGS. 16 & 17 disclose an embodiment of a rotary vacuum packaging machine, indicated generally by reference numeral 2, as follows. The rotary vacuum packaging machine 2 includes an endless chain 31 moving around a driving sprocket wheel 33 and larger driven sprocket wheel 35. Connected to the chain 31 is a plurality of bag supporting devices 37 for supporting loaded bags 39. Each of the supporting devices 37 includes a supporting platform 49 for receiving thereon one bag 39 fed by an infeed conveyor 17. A box-like vacuum cover 41 with an open bottom is pivotably suspended from the outer end of each supporting lever 43. Each of the supporting devices 37 also includes a base plate 51. Each vacuum cover 41 and base plate 51 mate together to form a vacuum box or vacuum chamber 45 of the rotary vacuum packaging machine 2. A longitudinal direction of the vacuum chamber 45 is defined as a direction in which each respective loaded bag 39 is fed into each vacuum chamber by being placed on the supporting platform 49 by the infeed conveyor 17. Each vacuum chamber 45 includes a heat seal assembly that is capable of forming a heat seal through a bag at a position near a bag mouth. The heat seal assembly is oriented transversely to the longitudinal direction of the vacuum chamber and includes a heating bar 47 and a pillow head 53. When an unsealed loaded bag is fed onto a supporting platform 49 by the conveyor 17, the bag mouth is located adjacent to the heat seal assembly. In order to heat seal the bag, the heating bar is forced downward against the pillow head, with the bag between the heating bar and the pillow head. While a loaded bag is being loaded into one of the vacuum chambers 45 by being placed on a supporting platform 49, a vacuum sealing operation is being performed on another loaded bag in another one of the vacuum chambers.

In some embodiments, a second conveyor (discussed below) is positioned downstream of the infeed conveyor 17, such that the second conveyor receives bags from the infeed conveyor 17 and then feeds bags onto the supporting platforms 49. Furthermore, in some embodiments, a placement conveyor (discussed below) is positioned to feed loaded bags onto an upstream end of the infeed conveyor 17, with respect to the direction of advancing a loaded bag to a supporting platform 49.

Figure 18:
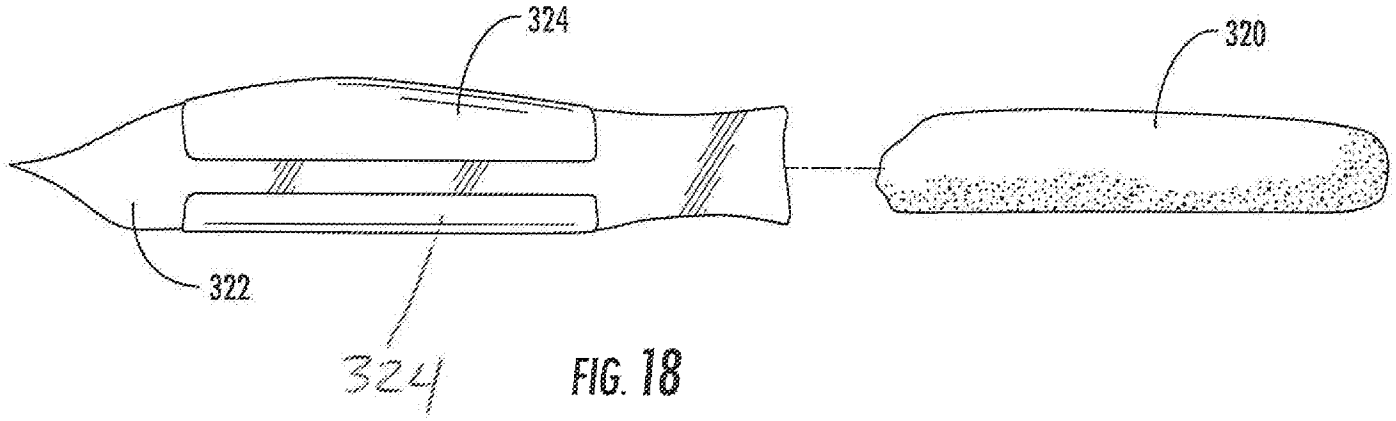
FIG. 18 is a side elevational view of a product being loaded in a bag.

FIG. 18 illustrates an embodiment of loading a product, e.g., an irregularly shaped piece of meat 320, into a bag 322 to produce a loaded bag. In FIG. 18, the bag includes two patches 324 adhered thereto. However, any type of polymeric bag that is suitable for vacuum sealing (e.g., a patch bag including one or more patches, or a patchless bag) may be used. Furthermore, any type of product, e.g., a meat product or a cheese product, may be loaded into the polymeric bag. A product with an irregular shape or a regular shape may be loaded into the polymeric bag. In addition, any method of loading a product into the bag may be used, including, but not limited to automatic loading using an automated apparatus, loading using a human operated apparatus, or loading by human hand.

Figure 19:
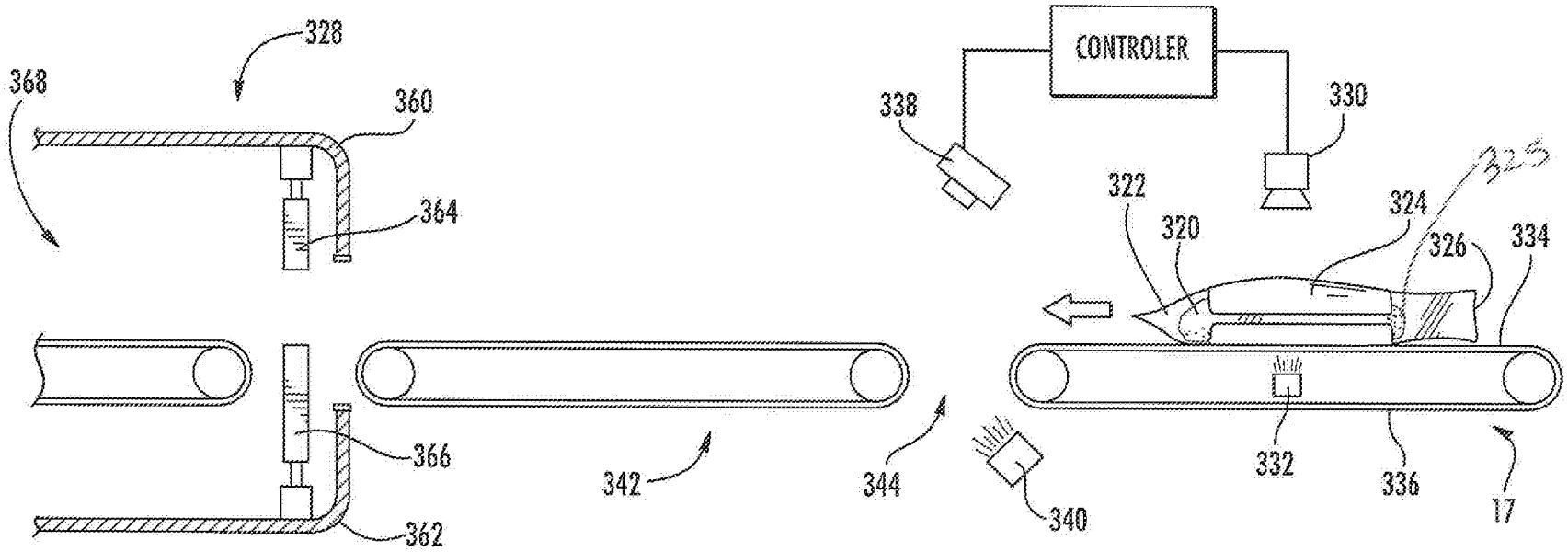
FIGS. 19 and 20 are side elevational views of an embodiment of a bag positioning apparatus.

FIGS. 19-22 illustrate an embodiment of a bag positioning apparatus, as follows. In FIG. 19, an unsealed bag 322, including two patches 324, is loaded with a product, e.g. meat 320, and has been placed on an infeed conveyor 17. The bag mouth 326 of the bag 322 is oriented at an upstream end of the bag relative to the direction of travel of the bag across the infeed conveyor toward a vacuum chamber 328. As the loaded bag travels across the infeed conveyor, the loaded bag is advanced to an infrared sensing apparatus including an infrared detector and a first radiation source. The infrared detector is oriented to detect infrared radiation that is emitted from the first radiation source, within an interrogating view of the infrared detector. In this embodiment, the infrared detector includes an infrared detecting camera 330, and the first radiation source includes a first array of LEDs 332. The infrared detecting camera 330 is disposed above of the infeed conveyor, and the first array of LEDs 332 is positioned within the infeed conveyor 17 between the upper portion 334 and lower portion 336 of the belt of the infeed conveyor. The first array of LEDs 332 emits infrared radiation upward through the upper portion of the infeed conveyor belt, and the infrared radiation is detected by the infrared detecting camera 330.

LEDILA435AP6-XQ (TM) or LEDIA80X80W (TM) arrays of LEDs, from Banner Engineering Corp., may be used as the first array of LEDs. A P40RS camera, from Banner Engineering Corp, may be used as the infrared detecting camera; or a PRESENCEPLUS™ P4AR infrared camera, a FLT1™ infrared filter, and a LCF04™ P4AR lens, each from Banner Engineering Corp., may be used as the infrared detecting camera.

Any type of bag (e.g., a patch bag including one or more patches, or a patchless bag) may be used with the apparatus that is illustrated in FIGS. 19-22. The material that is used for the bag transmits the infrared radiation that is emitted by the first radiation source by allowing the infrared radiation to pass through the bag. Furthermore, if a patch is adhered to the bag, the material that is used in the patch also transmits infrared radiation that is emitted by the first radiation source by allowing the infrared radiation to pass through the patch. However, the product that is loaded in either a patch bag or a patchless bag does not transmit infrared radiation.

The placement of the loaded bag on the infeed conveyor may be achieved by any method, including, but not limited to automatic placement using an automated apparatus, placement using a human operated apparatus, or placement by human hand.

An infrared detector may be mounted at any suitable height above the infeed conveyor, e.g., from 5 inches to 30 inches, 10 to 25 inches, or 15 to 20 inches above the infeed conveyor. The lower limit will be dictated at least in part by the height of the product being packaged, and the upper limit will be dictated at least in part by the capabilities of the infrared detector and the overall packaging environment in which the infrared sensing apparatus is located.

The infeed conveyor may transmit infrared radiation such that infrared radiation that is emitted from the first radiation source passes through the infeed conveyor. An embodiment of a belt for use as an infeed conveyor is an Intralox Series 1100, friction top flush gridlink belt, obtained from Intralox, LLC. Another embodiment of a belt useful as the infeed conveyor is the VOLTA™ FELW-2.0, obtained from Ammeraal Beltech.

In the embodiment that is illustrated in FIG. 19, the infrared sensing apparatus detects a trailing edge 325 of a product 320 in a bag 322, as follows. The first array of LEDs 332 emits infrared radiation upward through the upper portion 334 of the infeed conveyor 17. The infrared detecting camera 330 is positioned above the infeed conveyor 17 and the path of advancement of the loaded bag. The infrared detecting camera 330 is oriented to interrogate the infrared radiation that is emitted from the first array of LEDs 332 and transmitted through infeed conveyor 17. The interrogating view of the infrared detecting camera is oriented to capture infrared radiation emitted from the first array of LEDs 332 and to cover a path of a loaded bag toward a vacuum chamber 328. If a loaded bag is not present between the first array of LEDs 332 and the infrared detecting camera 330, and no object obstructs the transmission of the infrared radiation from the first array of LEDs 332 to the infrared detecting camera 330, the infrared detecting camera 330 detects the infrared radiation, in the interrogating view of the infrared detecting camera, as white pixels in a pixel window. When the loaded bag is advanced to a position on the infeed conveyor within the interrogating view of the infrared detecting camera 330, the infrared radiation passes through the both the bag and the patch (if the bag is a patch bag), but the infrared radiation does not pass through the product, e.g., meat 320, that is loaded in the bag. The infrared detecting camera 330 uses an internal algorithm to convert the blockage of the infrared radiation by the product 320, as viewed within the interrogating view of the infrared detecting camera 330, to an image of a grouping, silhouette, blob, etc. of dark or dark grayscale pixels within the pixel window. As the infeed conveyor 17 initially advances a loaded bag to the infrared sensing apparatus, and the leading edge of the product 320 that is loaded in the bag 322 initially passes into the interrogating view of infrared detecting camera 330, the algorithm in the infrared detecting camera 330 initially detects that at least a preset number or percentage of the dark or dark grayscale pixels appear in the pixel window, and the infrared detecting camera 330 transmits information to a controller that the product is present between the first array of LEDs 332 and the infrared detecting camera 330. When the infeed conveyor further advances the loaded bag past the infrared sensing apparatus so that the trailing edge 325 of the product 320 loaded in the bag passes through the interrogating view of the infrared detecting camera 330, the algorithm in the infrared detecting camera 330 shifts from detecting at least the preset number or percentage of dark or grayscale pixels to detecting less than the preset number or percentage of the dark or dark grayscale pixels in the pixel window, and the infrared detecting camera shifts from transmitting the information to the controller that the product is present between the infrared detecting camera and the first array of LEDs to transmitting information to the controller that the product is not present therebetween. When the infrared detecting camera shifts from transmitting the information to the controller that the product is present to transmitting the information to the controller that the product is not present, the controller records the position of the trailing edge of the product on the infeed conveyor as being below an edge of the pixel window of the infrared detecting camera that is closest to the vacuum chamber.

Figure 20:
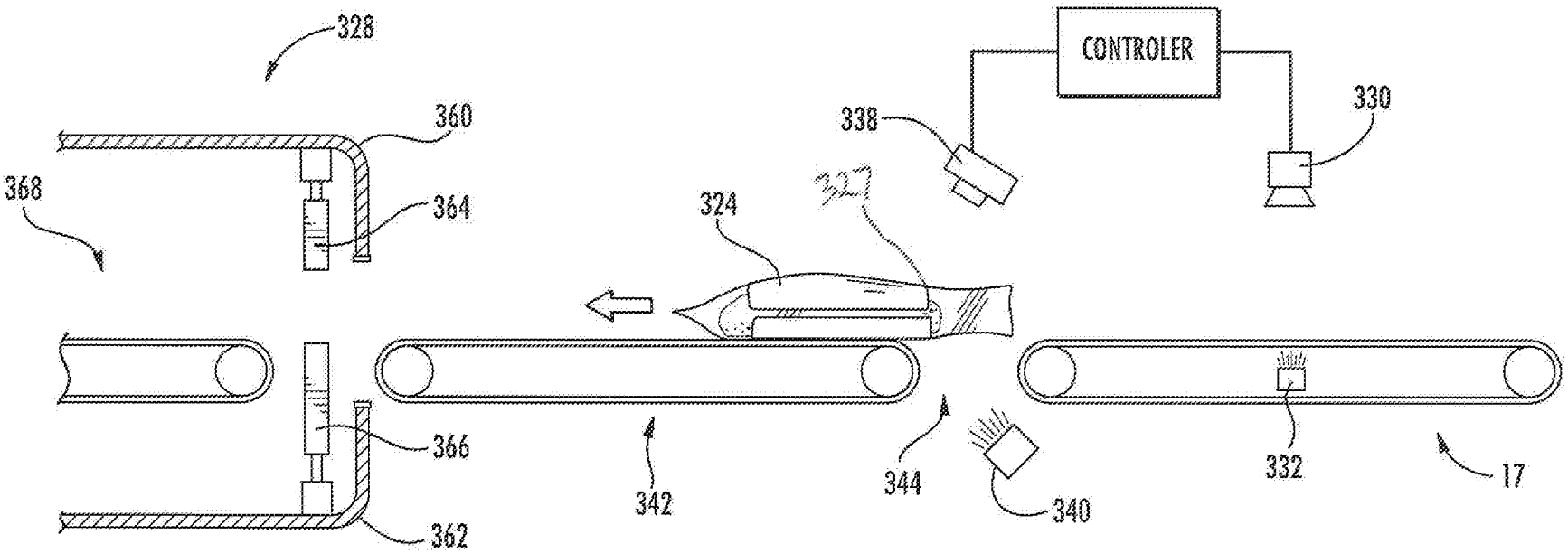

In the embodiment that is illustrated in FIG. 20, the unsealed and loaded patch bag is advanced to a fluorescence sensing apparatus located adjacent to an end of the infeed conveyor 17, as follows. The fluorescence sensing apparatus includes a fluorescence detector and a second radiation source. The fluorescence detector includes a fluorescence detecting camera 338, and the second radiation source includes a second array of LEDs 340 that emits ultraviolet radiation with a wavelength of 365 nm. The second array of LEDs is positioned below a gap 344 between the infeed conveyor 17 and a second conveyor 342. The second array of LEDs 340 is positioned to emit ultraviolet radiation through the gap 344.

For example, a GT1200*™ monochromatic CCD camera, from Matrox Electronic Systems Ltd., may be used as a fluorescence detecting camera; and a LEDUV365LA580AG6-XQ™, from Banner Engineering Corp., may be used as the second array of LEDs.

In embodiments where the fluorescence detector is positioned above a gap between conveyors, the width of the gap may be 1-3 inches. A fluorescence detector may be mounted at any suitable height above the gap, e.g., from 5 inches to 30 inches, 10 to 25 inches, or 15 to 20 inches above the gap. The lower limit will be dictated at least in part by the height of the product being packaged, and the upper limit will be dictated at least in part by the capabilities of the fluorescence detector and the overall packaging environment in which the fluorescence sensing apparatus is located.

In the embodiment that is illustrated in FIG. 20, the fluorescence sensing apparatus detects the trailing edge of a patch as follows. The fluorescence detecting camera 338 is positioned above both the gap and the path of the advancement of a bag. The interrogating view of the fluorescence detecting camera is oriented to cover the path of the loaded bag toward a vacuum chamber. If a patchless bag or no loaded bag is advanced between the second array of LEDs 340 and the fluorescence detecting camera 338, the fluorescence detecting camera detects no fluorescence. However, when a loaded patch bag is advanced into the interrogating view of the fluorescence detecting camera, the ultraviolet radiation that is emitted from the second array of LEDs 340 and through the gap 344 irradiates the fluorescent material in the patch, the fluorescent material in the patch is excited by the ultraviolet radiation, and the fluorescent material fluoresces. The fluorescence detecting camera 338 uses an internal algorithm to convert the fluorescence emitted from the fluorescent material in the patch, as viewed within the interrogating view of the fluorescence detecting camera, to a grouping, silhouette, blob, etc. of white or light grayscale pixels in a pixel window. When the leading edge of a patch is advanced to the interrogating view of the fluorescence detecting camera and the algorithm in the fluorescence detecting camera 338 initially detects at least a preset number or percentage of the white or light grayscale pixels in the pixel window, the fluorescence detecting camera outputs information to the controller that the patch is present between the second array of LEDs 340 and the fluorescence detecting camera 338. When the loaded patch bag is further advanced past the fluorescence sensing apparatus so that the trailing edge of the patch 327 adhered to the patch bag passes through the interrogating view of the fluorescence detecting camera 338, the algorithm in the fluorescence detecting camera shifts from detecting at least the preset number or percentage of white or light grayscale pixels to detecting less than the preset number or percentage of the white or light grayscale pixels in the pixel window, and the fluorescence detecting camera shifts from transmitting the information to the controller that the patch is present to transmitting the information to the controller that the patch is not present. When the fluorescence detecting camera shifts from transmitting the information to the controller that the patch is present to transmitting the information to the controller that the patch is not present, the controller records the position of the trailing edge of the patch as being below an edge of the pixel window of the fluorescence detecting camera that is closest to the vacuum chamber.

Figure 21:
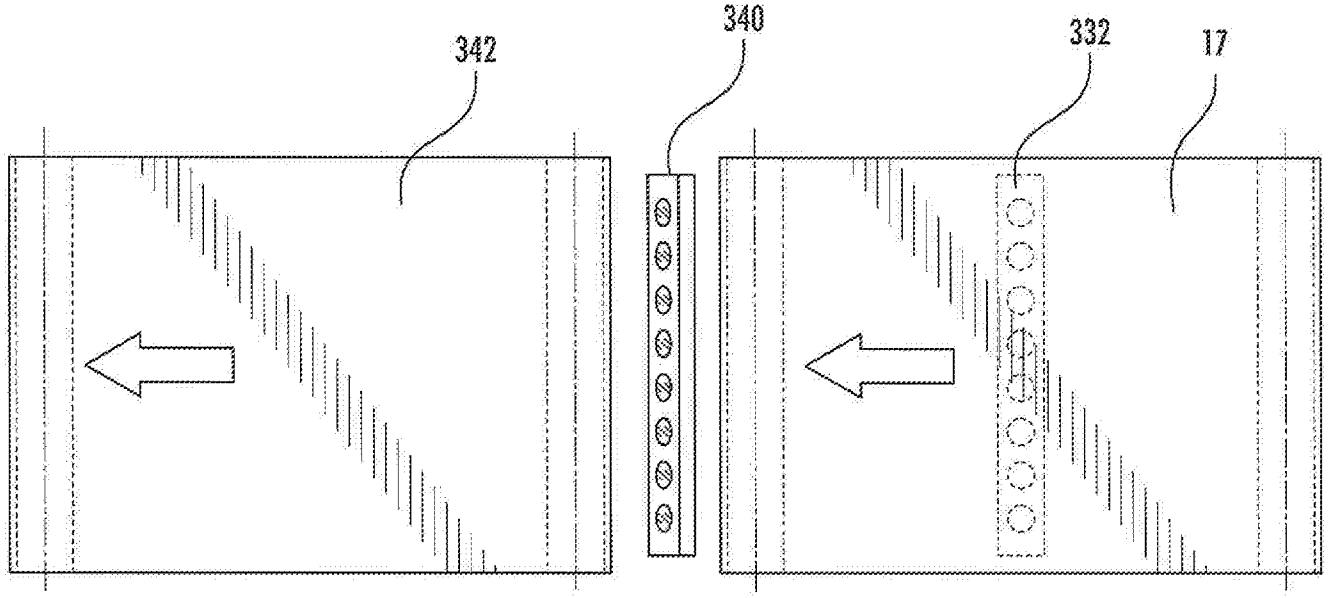
FIG. 21 is a partial plan view of the embodiment of the apparatus in FIGS. 19 and 20.

FIG. 21 illustrates an overhead view of the embodiment that is illustrated in FIGS. 19 and 20, including the infeed conveyor 17, the second conveyor 342, the first array of LEDs 332, and the second array of LEDs 340. The forward movement of the infeed conveyor and the second conveyor toward a vacuum chamber is shown by arrows.

Figure 22:
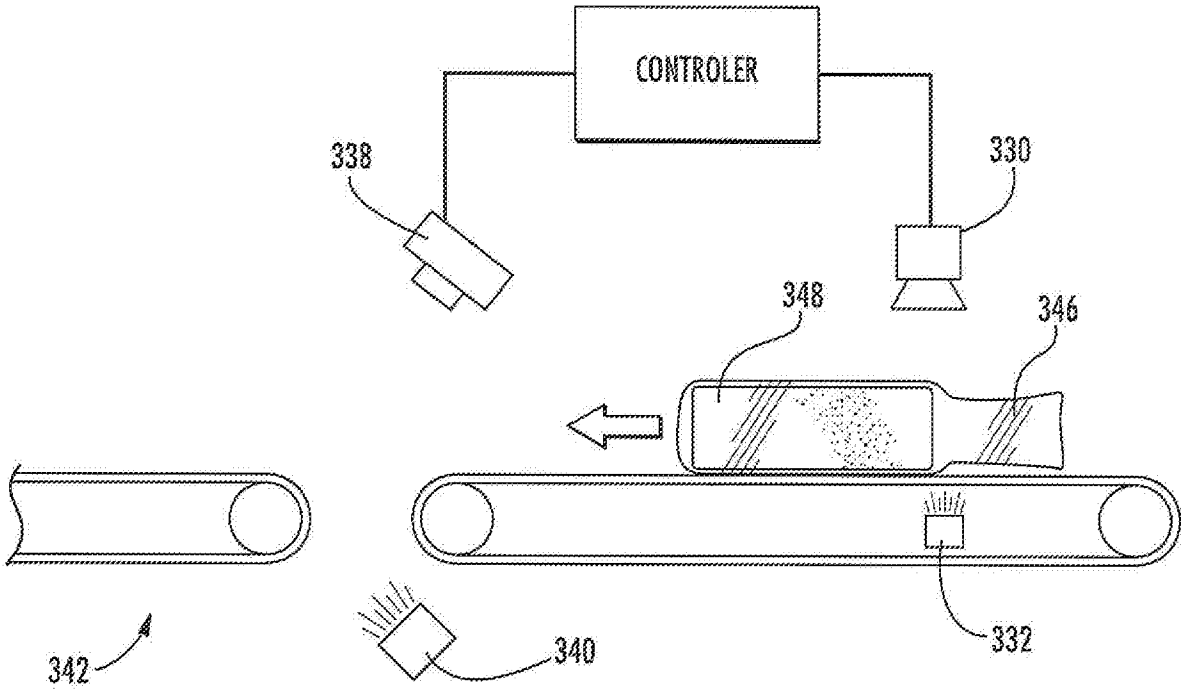
FIG. 22 is a partial side elevational view of the embodiment of the apparatus in FIGS. 19 and 20.

FIG. 22 illustrates a close up view of the infeed conveyor, the infrared sensing apparatus, the fluorescence sensing apparatus, and the second conveyor 342 of the embodiment of the apparatus that is illustrated in FIGS. 19 and 20. However, in FIG. 22, a patchless bag 346 loaded with a product, e.g., a block of cheese 348 having a regular shape, is resting on the infeed conveyor. The infeed conveyor advances the loaded patchless bag 346 past the infrared sensing apparatus and to the fluorescence sensing apparatus.

The bag positioning apparatus may be used to control the advancement of a stream of bags including loaded patch bags and/or loaded patchless bags into a vacuum chamber for the purpose of sealing the loaded bags in the appropriate position between the trailing edges of products loaded in the bags and bag mouths of the bags, and between trailing edges of patches (if the bags are patch bags) and bag mouths. The apparatus may be used to perform a method of positioning and vacuum sealing a stream of loaded bags including patchless bags and patch bags, such that a distance of advancement of a loaded patchless bag into the vacuum chamber is controlled by the controller based only on the information acquired from detecting the trailing edge of the product, and a distance of advancement of a loaded patch bag into the vacuum chamber is controlled by the controller based on the information acquired from detecting the trailing edge of the product and detecting the trailing edge of the patch.

In the embodiment that is illustrated in FIG. 22, only the trailing edge of the product in the loaded patchless bag is detected, since the patchless bag does not include a patch for detection by the fluorescence sensing apparatus. Therefore, when the patchless bag is fed through the apparatus, only the trailing edge of the product is detected when the infrared detecting camera 330 shifts from transmitting the information to a controller that the product is present to transmitting the information to the controller that the product is not present, and the controller records the position of the trailing edge of the product on the infeed conveyor as being below the edge of the pixel window of the infrared detecting camera that is closest to the vacuum chamber.

In addition, if a patch bag includes materials that allow the formation of a seal through the patch, a controller may be programmed to position the loaded patch based only on the position of the trailing edge of a product in the loaded patch bag, as detected by an infrared sensing apparatus, and a seal may be formed through the patch (if necessary) and between the trailing edge of the product in the patch bag and the bag mouth.

Figure 23:
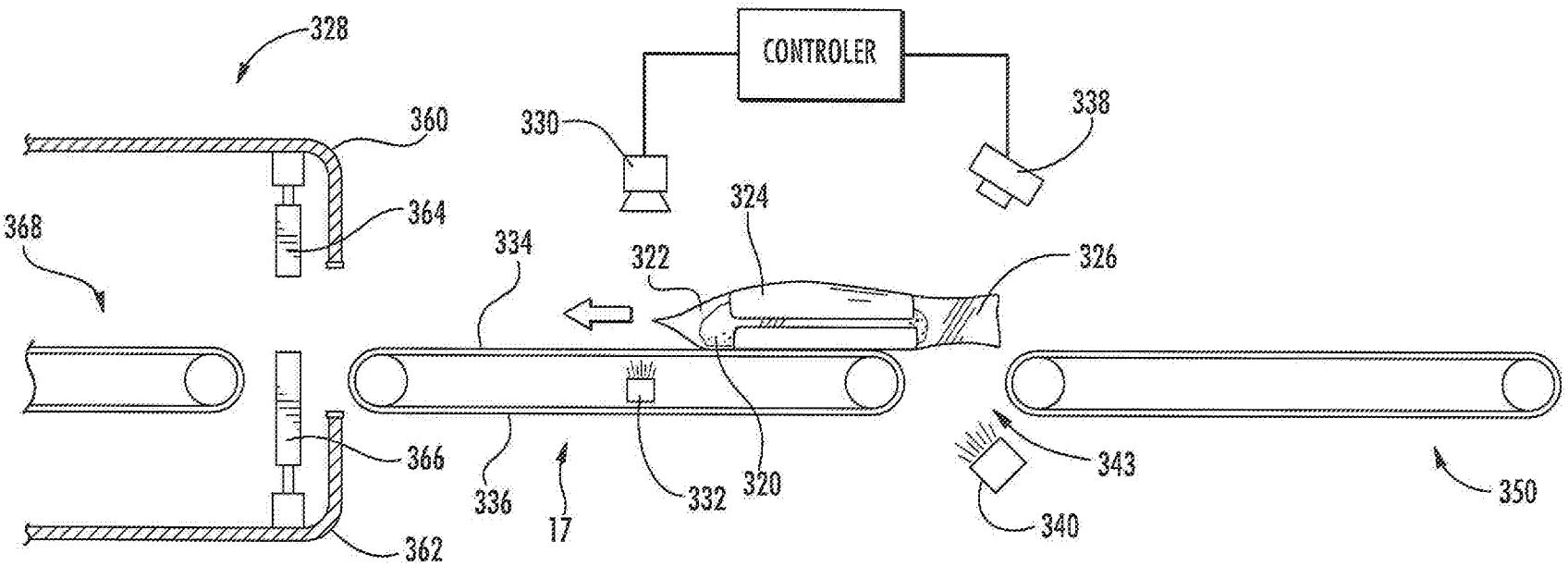
FIGS. 23 and 24 are side elevational views of an embodiment of a bag positioning apparatus.
Figure 24:
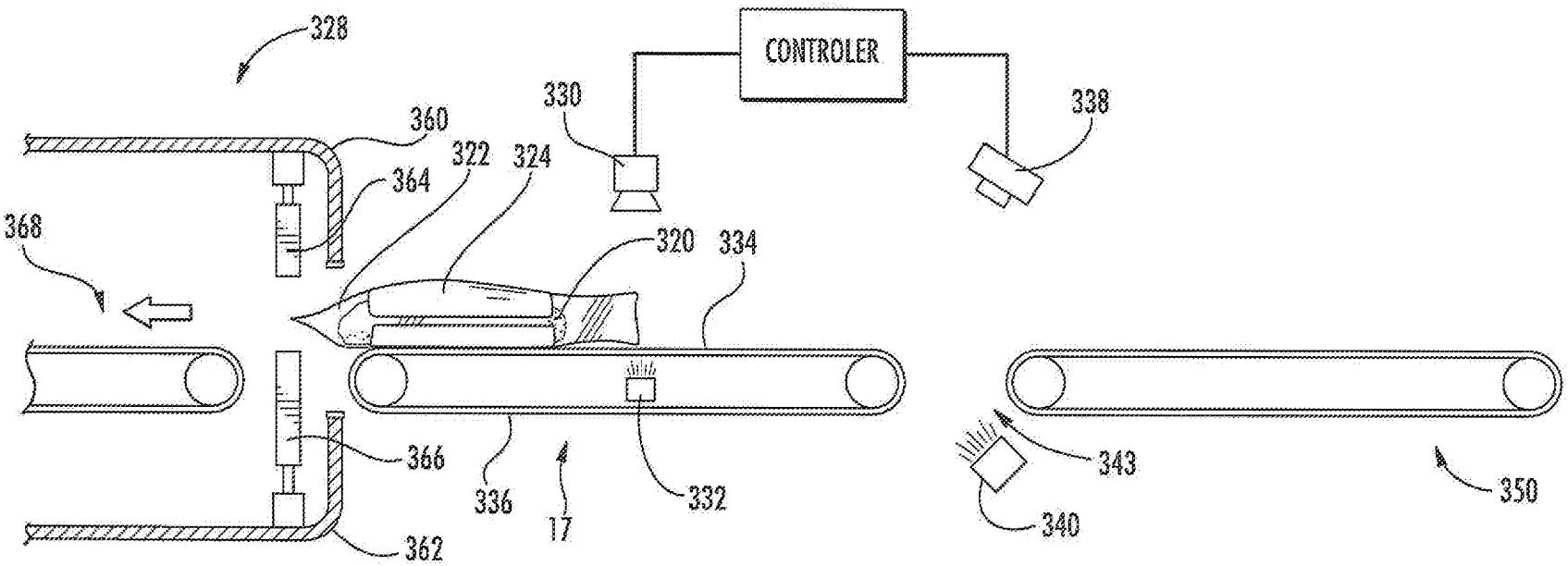
Figure 25:
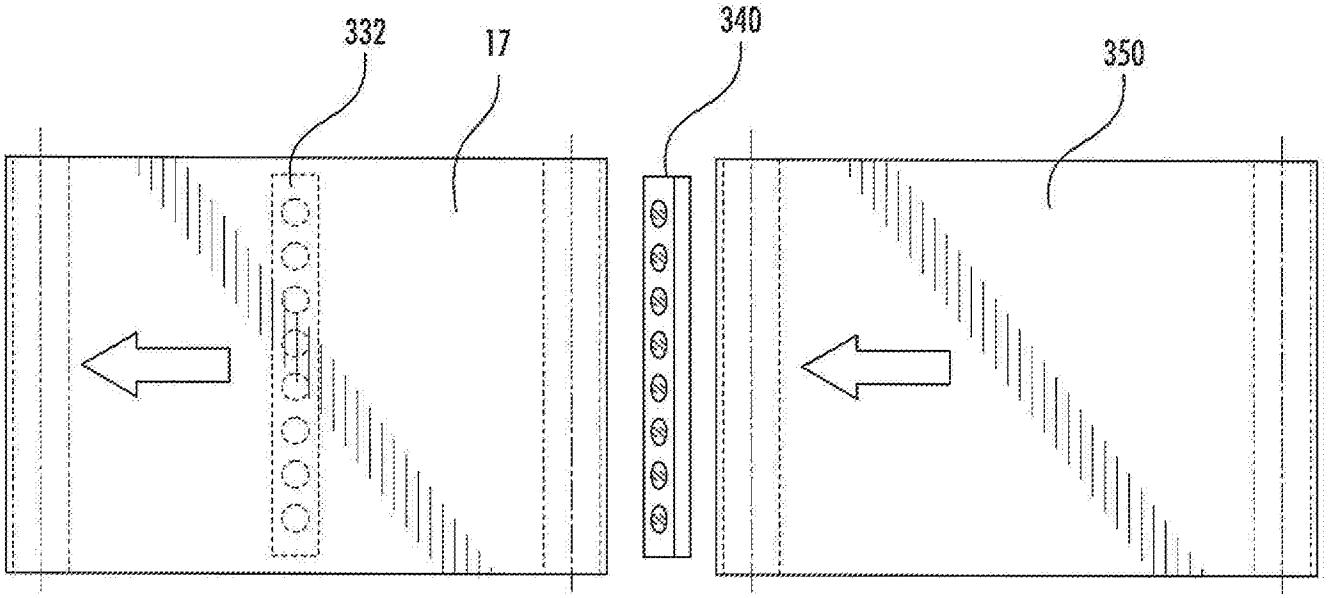
FIG. 25 is a partial plan view of the embodiment of the apparatus in FIGS. 23 and 24.

FIGS. 23-25 illustrate another embodiment of a bag positioning apparatus, as follows. In FIG. 23, an unsealed bag 322, including two patches 324, is loaded with a product, e.g., meat 320; and the loaded patch bag advances onto an infeed conveyor 17 from a placement conveyor 350. However, any type of bag (e.g., a patch bag including one or more patches, or a patchless bag) may be used with the apparatus that is illustrated in FIGS. 23-25. Bag mouth 326 of bag 322 is oriented at an upstream end of the bag relative to the direction of travel of the bag from placement conveyor 350 onto infeed conveyor 17 and toward vacuum chamber 328. As the loaded bag is transferred from the placement conveyor to the infeed conveyor, the loaded bag is advanced to a fluorescence sensing apparatus. The fluorescence sensing apparatus is positioned adjacent to gap 343 between the placement conveyor and the infeed conveyor, and the fluorescence sensing apparatus includes a fluorescence detector and a second radiation source. The second radiation source includes a second array of LEDs 340 that emit radiation with a wavelength of 365 nm through gap 343 between placement conveyor 350 and infeed conveyor 17. The fluorescence detector includes fluorescence detecting camera 338 that is positioned above both the gap and the path of the advancement of the loaded patch bag from the placement conveyor to the infeed conveyor. In FIG. 24, the loaded bag is advanced from the fluorescence sensing apparatus to an infrared sensing apparatus that includes a first radiation source and an infrared detector. The first radiation source includes first array of LEDs 332 that is positioned within infeed conveyor 17 between upper portion 334 and lower portion 336 of the belt of infeed conveyor 17. The infrared detector includes infrared detecting camera 330. The first array of LEDs 332 emits infrared radiation upward through the upper portion of infeed conveyor 17, and the infrared radiation is detected by infrared detecting camera 330, within an interrogating view of infrared detecting camera. FIG. 25 illustrates an overhead view of the embodiment illustrated in FIGS. 23 and 24, including the placement conveyor 350, infeed conveyor 17, first array of LEDs 332, and second array of LEDs 340. The forward movement of the placement conveyor and the infeed conveyor toward a vacuum chamber is shown by arrows.

The fluorescence sensing apparatus illustrated in FIGS. 23-25 detects a trailing edge of a patch in the same manner as the fluorescence sensing apparatus described above in connection with the embodiment that is illustrated in FIGS. 19-22, despite the fluorescence sensing apparatus being positioned adjacent to gap 343 between placement conveyor 350 and infeed conveyor 17 in the embodiment that is illustrated in FIGS. 23-25, and the fluorescence sensing apparatus being positioned adjacent to gap 344 between infeed conveyor 17 and second conveyor 342 in the embodiment that is illustrated in FIGS. 19-22. Furthermore, the infrared sensing apparatus illustrated in FIGS. 23-25 detects a trailing edge of a product in the same manner as the infrared sensing apparatus described above in connection with the embodiment illustrated in FIGS. 19-22, despite the infrared sensing apparatus being positioned downstream, in the direction of travel of a loaded bag, of the fluorescence sensing apparatus in the embodiment that is illustrated in FIGS. 23-25, and the infrared sensing apparatus being positioned upstream, in the direction of travel of a loaded bag, of the fluorescence sensing apparatus the embodiment that is illustrated in FIGS. 19-22.

A second radiation source may be angled or otherwise positioned to optimize irradiation of patches including fluorescent materials. In addition, a fluorescence detector may be angled to detect fluorescence emitted from a patch. However, any angling, including any arrangement where the second radiation source emits radiation vertically, and/or an arrangement where the fluorescence detector is arranged to detect fluorescence emitted vertically, may be used.

Figure 26:
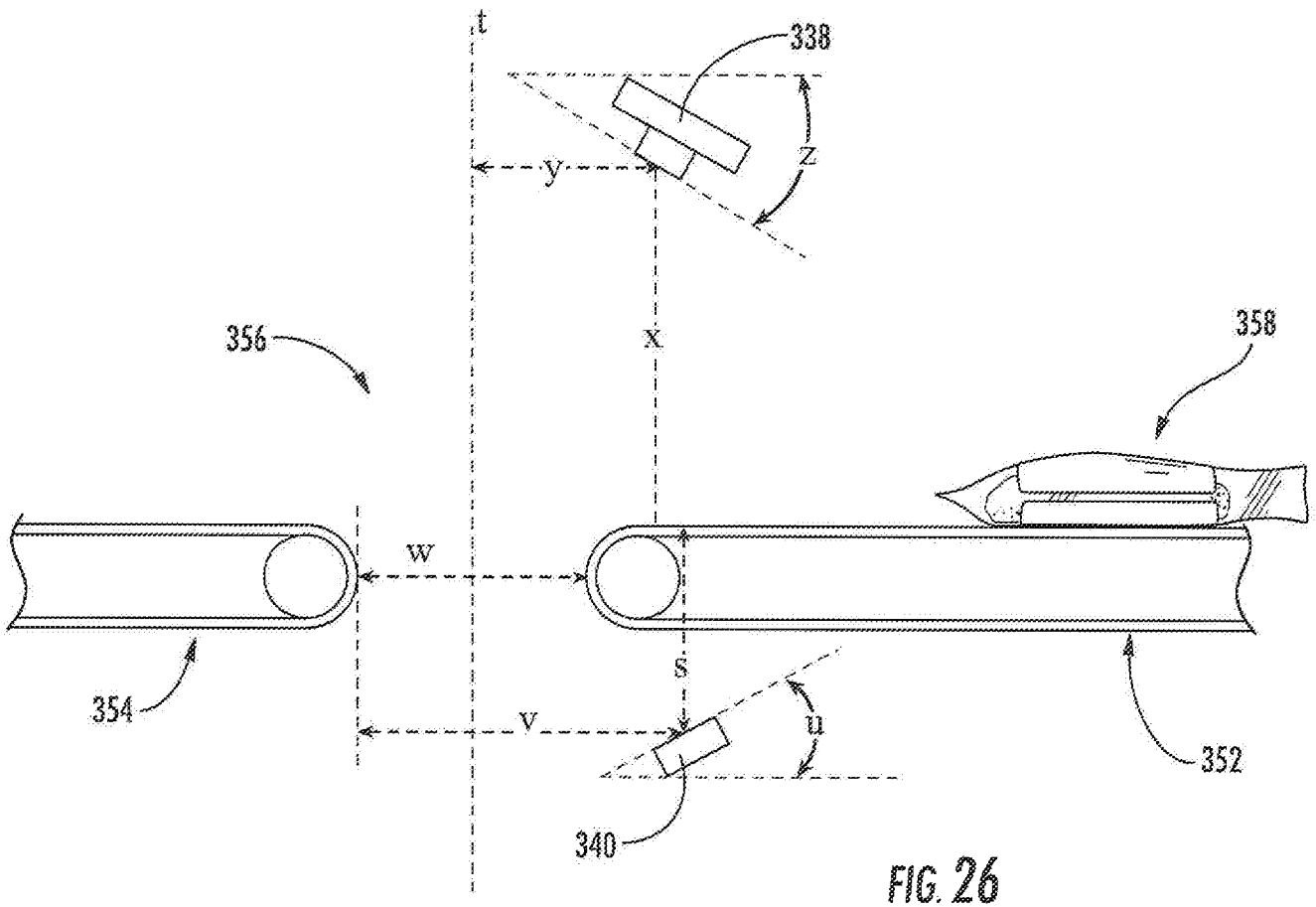
FIG. 26 is a side elevational view of an embodiment of a fluorescence sensing apparatus.

FIG. 26 illustrates an embodiment of a fluorescence sensing apparatus in which a loaded patch bag 358 advances on conveyor 352 toward the fluorescence sensing apparatus, which includes fluorescence detecting camera 338 and a second array of LEDs 340. Any type of bag (e.g., a patch bag including one or more patches, or a patchless bag) may be advanced past the fluorescence sensing apparatus that is illustrated in FIG. 26. A gap 356 exists between conveyor 352 and conveyor 354. A width of the gap is denoted by line (w). In some embodiments, the width of the gap (w) may be 1 to 3 inches, and even 2 inches. A center point of the second array of LEDs is located distance (v) from a vertical line tangent to the edge of conveyor 354. In some embodiments, distance (v) may be 1.5 to 3.5 inches, and even 2.5 inches. The center point of second array of LEDs 340 is also located distance (s) from the upper surface of conveyor 352. In some embodiments, distance (s) may be 8 to 10 inches, and even 9 inches. Second array of LEDs 340 may be inclined angle (u) from a leveled plane toward conveyor 354. In some embodiments, angle (u) may be 20° to 30°, and even 25°. When second array of LEDs 340 is inclined at an angle of 25°, the exposure of both the top and the bottom of the bag to ultraviolet radiation is maximized, as the trailing edge of the loaded bag passes over the gap from conveyor 352 to conveyor 354. A centerline between an edge of conveyor 352 and an edge of conveyor 354 is denoted by line (t). A center point of the lens of the fluorescence detecting camera is located distance (y) from line (t) and distance (x) from the upper portion of conveyor 352. In some embodiments, distance (y) may be 8 to 10 inches, and even 9 inches. In some embodiments, distance (x) may be 27.5 to 29.5 inches, and even 28.5 inches. The fluorescence detecting camera may be inclined angle (z) from a leveled plane toward conveyor 354. In some embodiments, angle (z) may be 25° to 35°, and even 30°. When the fluorescence detecting camera 338 is angled 30°, the camera may more distinctly capture fluorescence from the bottom side of the bag, as the bag passes over the gap.

A placement conveyor, an infeed conveyor, and/or a second conveyor may be supported by any appropriate support structure such as a frame or housing. An infrared sensing apparatus and/or a fluorescence sensing apparatus may be positioned within such frame or housing using brackets, arms, etc. An infrared sensing apparatus and/or a fluorescence sensing apparatus may be independently supported.

FIGS. 19, 20, 23, and 24 further illustrate an embodiment of an open vacuum chamber, as follows. The vacuum chamber includes vacuum chamber hood 360, a vacuum chamber base 362, and a heat seal assembly including heat seal bar 364 and heat seal anvil 366. The vacuum chamber further includes internal conveyor 368. A loaded bag may be transferred from a conveyor, e.g., infeed conveyor 17 or second conveyor 342, onto internal conveyor 368 when the vacuum chamber is in the open position with hood 360 separated vertically from contact with base 362. Furthermore, both heat seal bar 364 and heat seal anvil 366 are retractable to enable to the loaded bag to be moved past the heat seal assembly and onto the internal conveyor.

In an embodiment, one of the heat seal bar and the heat seal anvil is retractable to enable to the loaded bag to be moved past the heat seal assembly and onto the internal conveyor.

After a loaded bag has been advanced past both infrared sensing apparatus and fluorescence sensing apparatus in the embodiments illustrated in FIGS. 19, 20, 23, and 24, and information regarding the position of the trailing edge of the product in the loaded bag and the position of the trailing edge of the patch (if the loaded bag is a patch bag) has been collected and transmitted to the controller, the controller controls the distance of advancement of the loaded bag to a sealing position in the vacuum chamber by controlling the conveyors. Internal conveyor 368 may operate to move the loaded bag into a sealing position in the vacuum chamber according to instructions from the controller. The controller controls the advancement of the loaded bag to the sealing position in the vacuum chamber so that when heat seal bar 364 and heat seal anvil 366 are brought together to apply a heat seal, the heat seal is applied between the trailing edge of the product loaded in the bag and the bag mouth and between the trailing edge of the patch adhered to the bag (if the bag is a patch bag) and the bag mouth.

Figure 27:
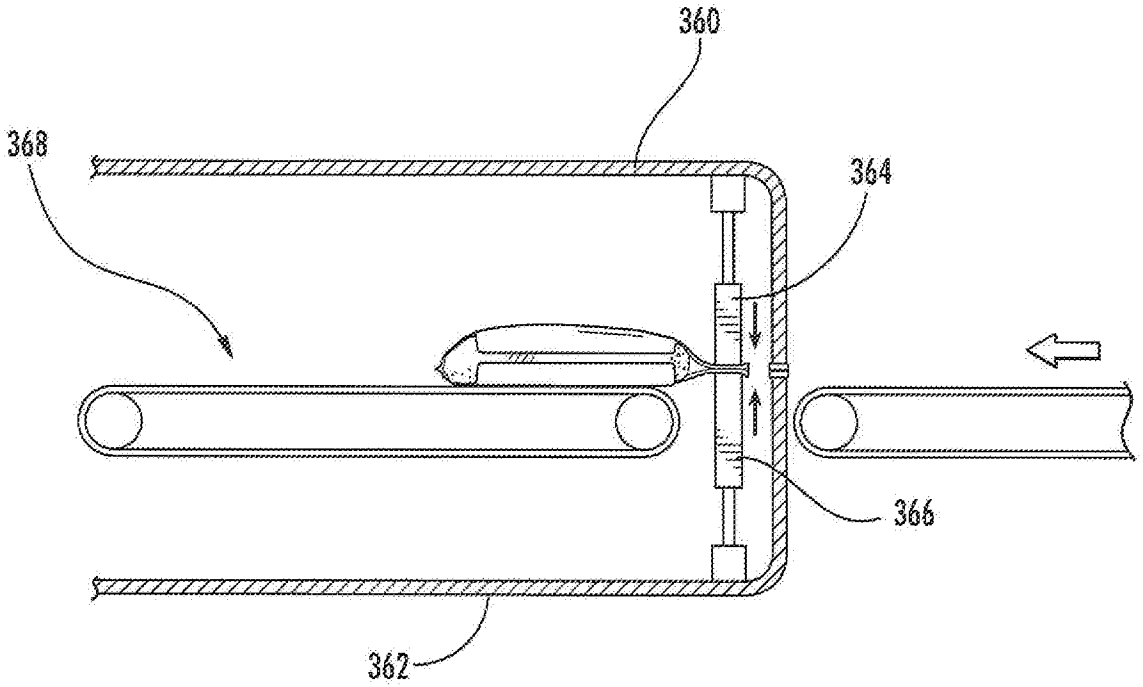
FIG. 27 is a side elevational view of a vacuum chamber.

FIG. 27 illustrates an embodiment of a vacuum chamber, which is also illustrated in FIGS. 19, 20, 23, and 24, in a closed position with heat seal bar 364 and heat seal anvil 366 applying a heat seal to the loaded bag. The heat seal is applied to the loaded bag after the vacuum chamber is in placed in the closed position and a vacuum is applied to the interior of the vacuum chamber. After the heat seal is applied to the loaded bag, the vacuum chamber is returned to atmospheric pressure and the vacuum chamber is opened. After a vacuum sealing operation is performed on a loaded bag in the vacuum chamber, the internal conveyor moves the vacuum sealed loaded bag out of the vacuum chamber.

The embodiments of the bag positioning apparatus that are illustrated in FIGS. 19, 20, 23, and 24 are not limited to use with the vacuum chambers illustrated in FIGS. 19, 20, 23, and 24. Bag positioning apparatuses may be used to feed loaded bags to the vacuum chambers of the vacuum packaging machine 1 illustrated in FIG. 10, vacuum chambers of the rotary vacuum packaging machine 2 illustrated in FIG. 16, vacuum chambers of the vacuum packaging machine comprising horizontally arranged vacuum chambers, etc.

Figure 28:
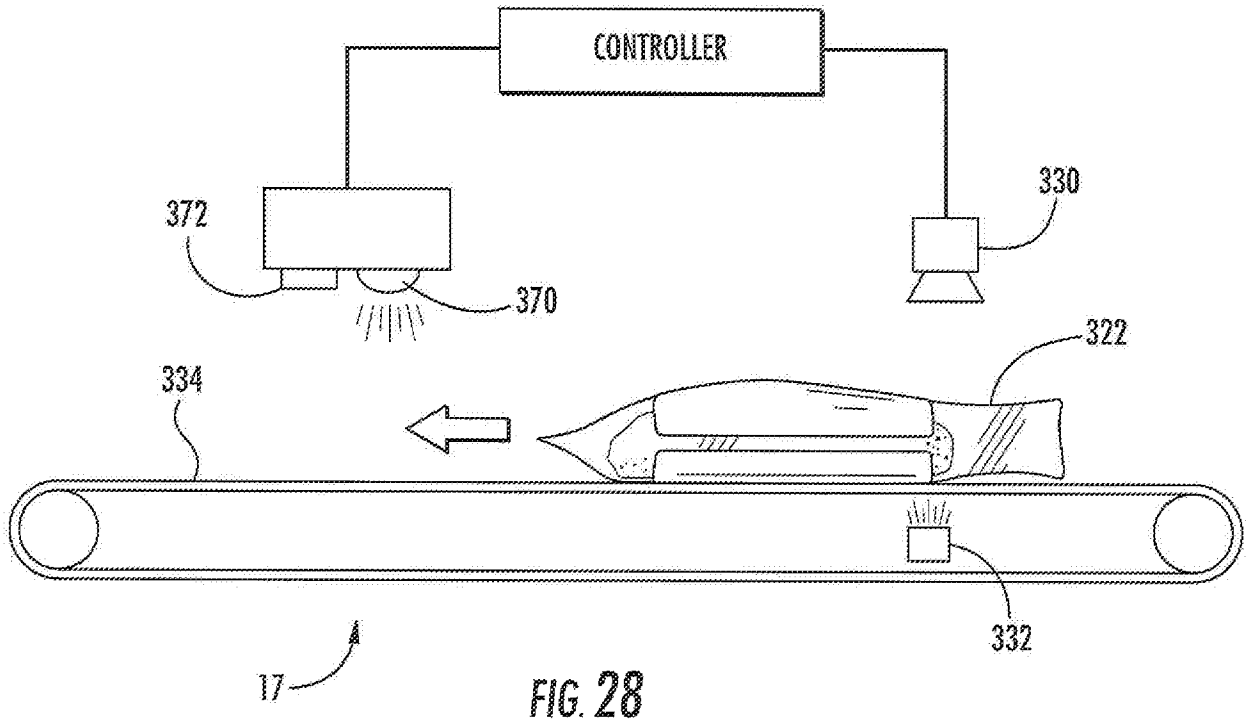
FIG. 28 is a side elevational view of an embodiment of a bag positioning apparatus.

FIG. 28 illustrates another embodiment of an apparatus. Any type of bag (e.g., a patch bag including one or more patches, or a patchless bag) may be used with the apparatus that is illustrated in FIG. 28. In this embodiment, the infrared sensing apparatus includes infrared detecting camera 330 and first radiation source 332. First radiation source 332 is positioned within infeed conveyor 17, just beneath upper portion 334 of infeed conveyor, and infrared detecting camera is positioned above the infeed conveyor. The infrared sensing apparatus that is illustrated in FIG. 28 detects a trailing edge of a product in the same manner as the infrared sensing apparatus described above in connection with the embodiment that is illustrated in FIGS. 19-22. The fluorescence sensing apparatus includes a second array of LEDs 370 and a fluorescence detecting sensor 372, and both the second array of LEDs 370 and the fluorescence detecting sensor 370 are positioned above an infeed conveyor 17 that is carrying a loaded bag. The interrogating view of the fluorescence detecting sensor is oriented to cover the path of the loaded bag toward a vacuum chamber. The second array of LEDs 370 emits ultraviolet radiation downward to toward the infeed conveyor 17. As a bag 322 with a patch adhered thereto is advanced to the fluorescence sensing apparatus, the second array of LEDs excite a fluorescent material that is included in the patch, and the fluorescent material fluoresces. The fluorescence detecting sensor detects the fluorescence that is emitted upward from the fluorescent material. When the fluorescence detecting sensor shifts from detecting the fluorescence from the fluorescent material to not detecting the fluorescence from the fluorescent material, as the loaded patch bag is advanced past the fluorescence sensing apparatus, the fluorescence detecting sensor sends information to the controller that the trailing edge of the patch adhered to the bag passed below fluorescence detecting sensor on the infeed conveyor. The controller records the position of the trailing edge of the patch based on the position of the infeed conveyor below the fluorescence detecting sensor at the time when the fluorescence detecting sensor sends the information to the controller that the trailing edge of the patch adhered to the bag passed below fluorescence detecting sensor on the infeed conveyor.

For example, a UVS-3™ sensor available from Tri-Tronics, P.O. Box 25135, Tampa, Fla. 33622-5135, may be used as a fluorescence sensor; and a LEDUV365LA580AG6-XQ™ available from Banner Engineering Corp. may be used as the second array of LEDs.

The trailing edge of a product may have a regular shape, e.g., the trailing edge of the product forms a substantially straight shape in a direction orthogonal to the path on which the product is conveyed past the infrared sensing apparatus. The trailing edge of a product may have an irregular shape, e.g., the trailing edge does not form a substantially uniform shape in a direction substantially orthogonal to the path on which the product is conveyed past the infrared sensing apparatus.

In an embodiment of the bag positioning apparatus (not shown), a single infrared detecting sensor is used as the infrared detector, as follows. The infrared detecting sensor detects a trailing edge of a product, when the trailing edge of the product has a regular shape, as the trailing edge of the product passes through the interrogating view of the infrared detecting sensor.

In an embodiment of the bag positioning apparatus (not shown), an array of infrared detecting sensors is used as the infrared detector, as follows. The array of infrared detecting sensors is positioned so as to transversely span a path of travel of a loaded bag between the first radiation source and the array of infrared detecting sensors. The array of infrared detecting sensors detects a trailing edge of a product, when the trailing edge of the product has an irregular or a regular shape, as the trailing edge of the product passes through the interrogating view of the array of infrared detecting sensors.

In an embodiment of the bag positioning apparatus (not shown), the first radiation source is positioned below both the upper and lower portions of the belt of the infeed conveyor so that the first radiation source emits infrared radiation upward through both the upper and lower portions of the belt of the infeed conveyor. In this embodiment, the infrared detector is positioned above both the upper and lower portions of the belt of the infeed conveyor, and the infrared detector detects the infrared radiation that is emitted upward by the first radiation source.

In an embodiment of the bag positioning apparatus (not shown), the fluorescence sensing apparatus is positioned adjacent to a gap between the infeed conveyor and an internal conveyor of a vacuum chamber. In this embodiment, the second radiation source is positioned to emit radiation through the gap and the fluorescence detector is positioned to detect fluorescence that is emitted by a patch adhered to a patch bag, when radiation from the second radiation source excites the fluorescent material in the patch.

In an embodiment of the bag positioning apparatus (not shown), the first radiation source is positioned above both the upper and lower portions of the belt of the infeed conveyor; and the infrared detector is positioned between the upper and lower portions of the belt of the infeed conveyor, so that the infrared radiation that is emitted downward from the first radiation source is detected by the infrared detector.

In an embodiment of the bag positioning apparatus (not shown), the first radiation source is positioned above both the upper and lower portions of the belt of the infeed conveyor; and the infrared detector is positioned below both the upper and lower portions of the belt of the infeed conveyor, so that the infrared radiation that is emitted downward from the first radiation source is detected by the infrared detector.

In an embodiment of the bag positioning apparatus (not shown), the first radiation source is located laterally to one side of the infeed conveyor and the infrared detector is disposed on an opposite lateral side of the infeed conveyor, so that the infrared detector detects infrared radiation that is emitted across the upper portion of the infeed conveyor by the first radiation source.

In an embodiment of the bag positioning apparatus (not shown), the second radiation source is positioned above a gap that exists between conveyors, the second radiation source emits ultraviolet radiation downward towards the gap, and the fluorescence detector is positioned within or below the gap. In this embodiment, the second radiation source is configured to emit radiation that excites a fluorescent material in a patch that is adhered to a bag that is travelling across the gap; and the fluorescence detector is configured to detect fluorescence that is emitted downward through the gap from the fluorescent material that has been excited by the second radiation source.

In an embodiment of the bag positioning apparatus (not shown), the second radiation source is positioned laterally to one side of a conveyor and the fluorescence detector is positioned on an opposite lateral side of the conveyor. In this embodiment, the second radiation source is configured to emit radiation across an upper surface of the conveyor so that the radiation excites a fluorescent material in a patch that is adhered to a bag; and the fluorescence detector is configured to detect fluorescence that is emitted from the fluorescent material across the conveyor.

In an embodiment of the bag positioning apparatus (not shown), both the infrared sensing apparatus and the fluorescence sensing apparatus are arranged side-by-side at substantially the same lateral position along the length of an infeed conveyor. In this embodiment, both the second radiation source and the fluorescence detector of the fluorescence sensing apparatus are positioned above an infeed conveyor. The first radiation source is positioned within the infeed conveyor or below the infeed conveyor, and the infrared detector is positioned above the infeed conveyor.

In an embodiment of the bag positioning apparatus (not shown), a fluorescence detecting sensor detects a trailing edge of a patch adhered to a patch bag as the trailing edge of the patch passes through the interrogating view of the fluorescence detecting sensor.

In an embodiment of the bag positioning apparatus (not shown), an array fluorescence detecting sensors detects a trailing edge of a patch adhered to a patch bag as the trailing edge of the patch passes through the interrogating view of the array fluorescence detecting sensors.

The controller may control the distance of advancement of a loaded bag to a sealing position in the vacuum chamber based in part on information that is collected by the infrared sensing apparatus and information that is collected by the fluorescence sensing apparatus. When a loaded patch bag or a loaded patchless bag is advanced by a conveyor to the infrared sensing apparatus, the infrared sensing apparatus detects the trailing edge of the product in the loaded bag; and, if a patch bag is advanced to the fluorescence sensing apparatus, the fluorescence sensing apparatus also detects the trailing edge of the patch adhered to the loaded bag. A number of different control configurations are available based on the components selected for the conveyors and the controller.

In some embodiments, a controller controls the distance of advancement of a loaded bag to a sealing position in a vacuum chamber based in part on encoder pulses that are output from motors that drive conveyors, e.g., the infeed conveyor, the second conveyor, the placement conveyor, and/or the internal conveyor, as follows. A known distance of linear travel corresponds to each encoder pulse. The controller includes a high speed counter that counts the encoder pulses from the conveyor(s). Preprogrammed within the controller is the number of encoder pulses (A) output from the motors of the conveyors that is required to move the trailing edge of the product in the loaded bag a known distance from the position of detection of the trailing edge of the product by the infrared sensing apparatus to a desired placement position within the vacuum chamber. Also preprogrammed within the controller is the number of encoder pulses (B) output from the motors of the conveyors that is required to move the trailing edge of the patch adhered to the loaded bag a known distance from the position of detection of the trailing edge of the patch by the fluorescence sensing apparatus to the desired placement position within the vacuum chamber.

The desired placement position may be a controlled distance downstream from the seal bar in the vacuum chamber, in the direction of travel of a loaded bag into the vacuum chamber. In some embodiments, the controlled distance is 0.5 to 3 inches. When closing the loaded bag by heat sealing the loaded bag, using the heat seal assembly, the heat seal may be applied between the trailing edge of the product and the bag mouth and between the trailing edge of the patch and the bag mouth. The heat seal may be applied at the controlled distance from the trailing edge of the product or the trailing edge of the patch, whichever is closer to the heat seal bar.

In one embodiment where the infrared sensing apparatus is positioned upstream of the fluorescence sensing apparatus with respect to the direction of travel of the loaded bag toward the vacuum chamber, the controller controls a distance of advancement of a loaded bag to a sealing position in the vacuum chamber, as follows. The controller counts the number of encoder pulses (C) that have accumulated since the trailing edge of the product in the loaded bag was detected by the infrared sensing apparatus. If the fluorescence sensing apparatus detects the trailing edge of a patch adhered to the loaded bag, the controller uses an algorithm to calculate the remaining number of encoder pulses (D) that is required to move the trailing edge of the product a remaining distance to the desired placement position by subtracting the number of encoder pulses (C) that have accumulated since the trailing edge of the product was detected from the preprogrammed number of encoder pulses (A) that is required to move the trailing edge of the product the known distance from the position of detection of the trailing edge of the product by the infrared sensing apparatus to the desired placement position. The controller uses the algorithm to advance the loaded patch bag a distance corresponding to the greater of either the remaining number of encoder pulses (D) that is required to move the trailing edge of the product the remaining distance to the desired placement position or the preprogrammed number of encoder pulses (B) that is required to move the trailing edge of the patch the distance from the position of detection of the trailing edge of the patch by the fluorescence sensing apparatus to the desired placement position. However, if the loaded bag is a patchless bag, the fluorescence sensing apparatus does not detect a patch and the controller advances the trailing edge of the product loaded in the patchless bag to the desired placement position based on the preprogrammed number of encoder pulses (A) that is required to move the trailing edge of the product the known distance from the position of detection of the trailing edge of the product to the desired placement position.

In another embodiment where the fluorescence sensing apparatus is positioned upstream of the infrared sensing apparatus with respect to the direction of travel of the loaded bag toward the vacuum chamber, the controller controls a distance of advancement of a loaded bag to a sealing position in the vacuum chamber, as follows. If the fluorescence sensing apparatus detects the trailing edge of a patch adhered to a loaded bag, the controller counts the number of encoder pulses (E) that have accumulated since the trailing edge of the patch was detected by the fluorescence sensing apparatus. When the infrared sensing apparatus detects the trailing edge of the product in the loaded patch bag, the controller uses an algorithm to calculate the remaining number of encoder pulses (F) that is required to move the trailing edge of the patch a remaining distance to the desired placement position by subtracting the number of encoder pulses (E) that have accumulated since the trailing edge of the patch was detected from the preprogrammed number of encoder pulses (B) that is required to move the trailing edge of the patch the known distance from the position of detection of the trailing edge of the patch by the fluorescence sensing apparatus to the desired placement position. The controller uses the algorithm to advance the loaded patch bag a distance corresponding to the greater of either the remaining number of encoder pulses (F) that is required to move the trailing edge of the patch the remaining distance to the desired placement position or the preprogrammed number of encoder pulses (A) that is required to move the trailing edge of the product the distance from the position of detection of the trailing edge of the product by the infrared sensing apparatus to the desired placement position. However, if the loaded bag is a patchless bag, the fluorescence sensing apparatus does not detect a patch and the controller advances the trailing edge of the product loaded in the patchless bag to the desired placement position based on the preprogrammed number of encoder pulses (A) that is required to move the trailing edge of the product the known distance from the position of detection of the trailing edge of the product to the desired placement position.

In other embodiments, a controller controls the distance of advancement of a loaded bag to a sealing position in a vacuum chamber based in part on variable speed control. In an embodiment of controlling the distance of advancement of a loaded patch bag to a sealing position in a vacuum chamber using variable speed control, the controller uses information related to the speed, acceleration, and deceleration of motors of the conveyors, as well as the distance between the location where the trailing edge of the product is detected by the infrared sensing apparatus and the desired placement position, and the distance between the location where the trailing edge of the patch is detected by the fluorescence sensing apparatus and the desired placement position to control the distance of advancement of the loaded patch bag. In an embodiment of controlling the distance of advancement of a loaded patchless bag to a sealing position in a vacuum chamber using variable speed control, the controller uses information related to the speed, acceleration, and deceleration of motors of the conveyors, as well as the distance between the location where the trailing edge of the product is detected by the infrared sensing apparatus and the desired placement position to control the distance of advancement of the loaded patchless bag.

In other embodiments, a controller controls the distance of advancement of a loaded bag to a sealing position in a vacuum chamber based in part on resolvers that determine the number of rotations and angular position of motors that drive the conveyors. In an embodiment of controlling the distance of advancement of a loaded patch bag to a sealing position in a vacuum chamber using information from resolvers, the controller uses information related to the number of rotations and angular position of motors of the conveyors, as well as the distance between the location where the trailing edge of the product is detected by the infrared sensing apparatus and the desired placement position, and the distance between the location where the trailing edge of the patch is detected by the fluorescence sensing apparatus and the desired placement position to control the distance of advancement of the loaded patch bag. In an embodiment of controlling the distance of advancement of a loaded patchless bag to a sealing position in a vacuum chamber using information from resolvers, the controller uses information related to the number of rotations and angular position of the motors of the conveyors, as well as the distance between the location where the trailing edge of the product is detected by the infrared sensing apparatus and the desired placement position to control the distance of advancement of the loaded patchless bag.

An embodiment of a method of positioning and sealing a bag in a vacuum chamber may include the following. A bag may be loaded by placing a product, e.g., meat product or cheese product, in the bag in order to produce a loaded bag. The product may have a regular or an irregular shape. The bag may include an upstream end including a bag mouth, with respect to a direction that the bag is fed toward the vacuum chamber. The bag may further include a patch adhered thereto. However, both patch bags and patchless bags may be used in connection with the method of positioning and sealing a bag in a vacuum chamber. The patch may include a fluorescent material, and the bag and the patch may both be transparent to infrared radiation. The loaded bag may be placed on an infeed conveyor, and the loaded bag may be advanced on the infeed conveyor to an infrared sensing apparatus including an infrared detector and a first radiation source. The infeed conveyor may be transparent to infrared radiation. The infrared detector may be disposed on an opposite side of the infeed conveyor from the first radiation source. The method may include detecting a trailing edge of the product inside the loaded bag by interrogating, through the loaded bag, infrared radiation emitted from the first radiation source, using the infrared detector of the infrared sensing apparatus. The loaded bag may be advanced to a fluorescence sensing apparatus including a fluorescence detector and a second radiation source. The second radiation source may include an array of LEDs that emits radiation with a wavelength of 365 nm. The method may include detecting a trailing edge of the patch by interrogating fluorescence emitted by the patch using the fluorescence sensing apparatus. The radiation emitted by the second radiation source may excite the fluorescent material. Information collected while the detecting the trailing edge of the product and detecting the trailing edge of the patch may be acquired and transmitted to a controller. The controller may control the distance of advancement of the loaded bag to a sealing position in the vacuum chamber based on the information acquired from detecting the trailing edge of the product and detecting the trailing edge of the patch. The vacuum chamber may include a heat seal assembly. The method may include closing the loaded bag by heat sealing using the heat seal assembly, so that a heat seal is applied between the trailing edge of the product and the bag mouth and between the trailing edge of the patch and the bag mouth. The vacuum may be applied to the loaded bag within the vacuum chamber before the closing the loaded bag.

In an embodiment of the method of positioning and sealing a bag in a vacuum chamber, the fluorescence sensing apparatus is disposed adjacent to an end of the infeed conveyor.

In an embodiment of the method of positioning and sealing a bag in a vacuum chamber, the heat seal is applied at a controlled distance from the trailing edge of the product or the trailing edge of the patch. The controlled distance may be 0.5 to 3 inches.

In an embodiment of the method of positioning and sealing a bag in a vacuum chamber, the vacuum chamber includes an internal conveyor moveable in a longitudinal direction of the vacuum chamber to expel the loaded bag from the vacuum chamber after closing the loaded bag. A portion of the internal conveyor may extend under a portion of the heat seal assembly in the vacuum chamber. On the other hand, at least a portion of the heat seal assembly, e.g. 364 seal bar and 366 seal anvil, may be retractable to enable the loaded bag to be moved past the heat seal assembly and onto the internal conveyor.

An embodiment of the method of positioning and sealing a bag in a vacuum chamber may include transferring the loaded bag from a placement conveyor to the infeed conveyor, such that radiation emitted from the second radiation source excites the fluorescent material through a gap between the placement conveyor and the infeed conveyor.

In an embodiment of the method of positioning and sealing a bag in a vacuum chamber, the infrared detector is disposed above the infeed conveyor and the first radiation source.

In an embodiment of the method of positioning and sealing a bag in a vacuum chamber, the loaded bag is advanced along the infeed conveyor during while detecting a trailing edge of the product.

In an embodiment of the method of positioning and sealing a bag in a vacuum chamber, the method is performed in combination with a method of vacuum sealing a stream of loaded bags comprising patchless bags and patch bags, such that a distance of advancement of a loaded patchless bag into the vacuum chamber is controlled by the controller based only on the information acquired from detecting the trailing edge of the product.

In an embodiment of the method of positioning and sealing a bag in a vacuum chamber, the trailing edge of the patch is detected before the trailing edge of the product is detected. In another embodiment of a method of positioning and sealing a bag in a vacuum chamber, the trailing edge of the patch is detected after the trailing edge of the product is detected.

Embodiments of the method of positioning and sealing a bag in a vacuum chamber may be performed in combination with a method of vacuum sealing a loaded bag, which includes the use of a vacuum packaging machine (e.g., vacuum packaging machine 1, a vacuum packaging machine comprising horizontally arranged vacuum chambers, rotary vacuum packaging machine 2, etc.) including at least two vacuum chambers. The vacuum chambers may each be configured to receive a respective unsealed loaded bag and perform a vacuum sealing operation on the respective loaded bag. The vacuum chambers may each include a longitudinal direction defined by a path of travel of the respective loaded bag into the chamber, and the chambers may each include a heat seal assembly for forming a heat seal across a bag mouth of the respective loaded bag loaded therein. The heat seal assembly may be disposed transversely to the longitudinal direction. Each respective unsealed loaded bag may be fed into one of the vacuum chambers, such that the bag mouth of the respective loaded bag is located adjacent to the heat seal assembly. A vacuum sealing operation may be performed on another loaded bag in another vacuum chamber of the at least two vacuum chambers. An unsealed loaded bag may be fed into one of the vacuum chambers at the same time that a vacuum sealing operation is being performed on another loaded bag in another vacuum chamber.

The vacuum chambers may moveable relative to the infeed conveyor to enable selective feeding of a single loaded bag into each chamber. On the other hand, an infeed conveyor may moveable relative to the vacuum chambers to enable selective feeding of a single loaded bag into each chamber.

"Loaded" herein refers to a bag in which a product, such as a meat product, has been placed manually, mechanically, or otherwise. "Loaded" does not necessarily mean "filled", as conventional bagged meat packages can have some empty voids or spaces within the bag interior even after loading the bag.

Although the disclosure primarily refers to meat and cheese products, it should be understood that the disclosure applies to packaging other products as well, both food products and non-food products.

To the extent that the disclosure in documents that are incorporated herein by reference is inconsistent with the disclosure in the text of this document, the disclosure in the text of this document controls.

The exemplary embodiments shown in the figures and described above illustrate but do not limit the subject matter disclosed in this specification. It should be understood that there is no intention to limit the subject matter in this specification to the specific form disclosed; rather, the disclosed subject matter is to cover all modifications and alternative constructions, as well as equivalents falling within the spirit and scope of the subject matter recited in the claims.

What is claimed is:

1. A method of positioning and sealing a bag in a vacuum chamber, the method comprising:

loading the bag by placing a product in the bag to produce a loaded bag, the bag including an upstream end including a bag mouth, the bag further including a patch adhered thereto, the patch including a fluorescent material, the bag and the patch both being transparent to infrared radiation;

placing the loaded bag on an infeed conveyor;

advancing the loaded bag, on the infeed conveyor, to an infrared sensing apparatus including an infrared detector and a first radiation source, the infrared detector being disposed on an opposite side of the infeed conveyor from the first radiation source;

detecting a trailing edge of the product inside the loaded bag by interrogating, through the loaded bag, infrared radiation emitted from the first radiation source, using the infrared sensing apparatus;

advancing the loaded bag to a fluorescence sensing apparatus including a fluorescence detector and a second radiation source;

detecting a trailing edge of the patch by interrogating fluorescence emitted by the patch using the fluorescence sensing apparatus, wherein radiation emitted by the second radiation source excites the fluorescent material;

acquiring information from detecting the trailing edge of the product and detecting the trailing edge of the patch, and transmitting the information to a controller;

controlling a distance of advancement of the loaded bag to a sealing position in the vacuum chamber including a heat seal assembly, using the controller, based on the information acquired from detecting the trailing edge of the product and detecting the trailing edge of the patch; and closing the loaded bag by heat sealing the loaded bag, using the heat seal assembly, so that a heat seal is applied between the trailing edge of the product and the bag mouth and between the trailing edge of the patch and the bag mouth.

2. The method according to claim 1, further comprising applying vacuum to the loaded bag within the vacuum chamber before closing the loaded bag.

3. The method according to claim 1, wherein the infeed conveyor is transparent to infrared radiation.

4. The method according to claim 1, wherein the fluorescence sensing apparatus is disposed adjacent to an end of the infeed conveyor.

5. The method according to claim 1, wherein the fluorescence detector includes a fluorescence detecting camera or a fluorescence detecting sensor, and the infrared detector includes an infrared detecting camera or an infrared detecting sensor.

6. The method according to claim 1, wherein the second radiation source includes an ultraviolet radiation source.

7. The method according to claim 1, wherein the first radiation source includes a first array of light emitting diodes and the second radiation source includes a second array of light emitting diodes.

8. The method according to claim 1, wherein the heat seal is applied at a controlled distance from the trailing edge of the product or the trailing edge of the patch.

9. The method according to claim 8, wherein the controlled distance is 0.5 to 3 inches.

10. The method according to claim 1, wherein the product is a meat product or a cheese product.

11. The method according to claim 1, wherein the product is a meat product including an irregular shape.

12. The method according to claim 1, wherein the vacuum chamber includes an internal conveyor moveable in a longitudinal direction of the vacuum chamber to expel the loaded bag from the vacuum chamber after closing the loaded bag.

13. The method according to claim 12, wherein a portion of the internal conveyor extends under a portion of the heat seal assembly in the vacuum chamber.

14. The method according to claim 12, wherein at least a portion of the heat seal assembly is retractable to enable the loaded bag to be moved past the heat seal assembly and onto the internal conveyor.

15. The method according to claim 1, further comprising transferring the loaded bag from a placement conveyor to the infeed conveyor, wherein the radiation emitted from the second radiation source excites the fluorescent material through a gap between the placement conveyor and the infeed conveyor.

16. The method according to claim 1, wherein the infrared detector is disposed above the infeed conveyor and the first radiation source.

17. The method according to claim 1, wherein the trailing edge of the product is detected as the loaded bag is advanced along the infeed conveyor.

18. The method according to claim 1, wherein the method is performed in combination with a method of vacuum sealing a stream of loaded bags including patchless bags and bags including patches adhered thereto, wherein a distance of advancement of a loaded patchless bag into the vacuum chamber is controlled by the controller based only on the information acquired from detecting the trailing edge of the product.

19. The method according to claim 1, wherein the trailing edge of the patch is detected before the trailing edge of the product is detected.

20. The method according to claim 1, wherein the controller is a programmable logic controller.

21. The method according to claim 1, wherein the method is performed in combination with a method of vacuum sealing a loaded bag comprising:

providing a vacuum packaging machine including at least two vacuum chambers, wherein each of the at least two vacuum chambers is configured to receive a respective unsealed loaded bag and perform a vacuum sealing operation on the respective loaded bag, each of the at least two vacuum chambers includes a longitudinal direction defined by a path of travel of the respective loaded bag into the chamber, each of the at least two vacuum chambers includes a heat seal assembly for forming a heat seal across a bag mouth of the respective loaded bag, the heat seal assembly is disposed transversely to the longitudinal direction;

feeding the respective unsealed loaded bag into one of the at least two vacuum chambers, such that the bag mouth of the respective loaded bag is located adjacent to the heat seal assembly; and performing a vacuum sealing operation on another loaded bag in another vacuum chamber of the at least two vacuum chambers.

22. The method according to claim 21, wherein the at least two vacuum chambers are moveable relative to the infeed conveyor to enable selective feeding of a single loaded bag into each chamber of the at least two vacuum chambers.

23. The method according to claim 21, wherein the vacuum packaging machine is a rotary vacuum packaging machine.

24. The method according to claim 21, wherein the respective unsealed loaded bag is fed into one of the at least two vacuum chambers while performing a vacuum sealing operation on another loaded bag in another vacuum chamber of the at least two vacuum chambers.

* * * * *